US005488741A

United States Patent [19]

Hunnicutt, Jr.

[11] Patent Number: 5,488,741

[45] Date of Patent: Feb. 6, 1996

[54] TOILET BOWL VENTILATING AND DEODORIZING APPARATUS

[76] Inventor: Clyde J. Hunnicutt, Jr., 3026 E. Garfield St., Phoenix, Ariz. 86008

[21] Appl. No.: 124,815

[22] Filed: Sep. 21, 1993

[51] Int. Cl.[6] ..... E03D 9/052

[52] U.S. Cl. ..... 4/213; 4/347; 4/352

[58] Field of Search ..... 4/213, 216, 217, 4/347, 348, 352

[56] References Cited

U.S. PATENT DOCUMENTS

| | | | |
|---|---|---|---|
| 386,115 | 7/1888 | Douglas . | |
| 1,767,930 | 6/1930 | Kahl . | |
| 1,798,457 | 3/1931 | Cole | 4/213 |
| 1,977,758 | 10/1934 | Epler | 4/213 |
| 2,001,592 | 5/1935 | Teetor | 4/213 |
| 2,001,593 | 5/1935 | Teetor | 4/213 |
| 2,017,590 | 10/1935 | Puttner | 4/213 |
| 2,129,048 | 9/1938 | Davis | 4/213 |
| 2,301,738 | 11/1942 | Miller | 4/213 |
| 2,320,065 | 5/1943 | Briscoe et al. | 4/213 |
| 2,728,088 | 12/1955 | Gudish | 4/217 |
| 2,747,201 | 5/1956 | Herriott | 4/213 |
| 2,988,756 | 6/1961 | Hartley | 4/213 |
| 3,003,157 | 10/1961 | Belcher | 4/217 |
| 3,069,696 | 12/1962 | Howell | 4/213 |
| 3,230,551 | 1/1966 | Kopp | 4/213 |
| 3,335,431 | 8/1967 | Coates | 4/213 |
| 3,366,979 | 2/1968 | Johnston | 4/213 |
| 3,386,109 | 6/1968 | Christian et al. | 4/217 |
| 3,416,167 | 12/1968 | Klemme | 4/217 |
| 3,533,112 | 10/1970 | Poister | 4/213 |
| 3,571,824 | 3/1971 | Poister | 4/213 |
| 3,824,637 | 7/1974 | Hunnicutt, Jr. | 4/213 |
| 3,857,119 | 12/1974 | Hunnicutt, Jr. | 4/213 |
| 3,927,429 | 12/1975 | Poarson | 4/213 |
| 3,953,901 | 5/1976 | Poister et al. | 4/213 |
| 3,966,075 | 6/1976 | Schaltz | 220/1.5 |
| 4,025,325 | 5/1977 | Goodwin, Jr. | 4/217 |
| 4,168,553 | 9/1979 | Studer | 4/348 |
| 4,175,293 | 11/1979 | Stephens et al. | 4/209 |
| 4,317,242 | 3/1982 | Stamper | 4/213 |
| 4,375,704 | 3/1983 | Smith | 4/213 |
| 4,472,841 | 9/1984 | Faulkner | 4/213 |
| 4,853,981 | 8/1989 | Hunnicutt, Jr. | 4/213 |

FOREIGN PATENT DOCUMENTS

| | | | |
|---|---|---|---|
| 214098 | 3/1987 | European Pat. Off. | 4/213 |
| 1347873 | 11/1962 | France | 4/213 |

*Primary Examiner*—Henry J. Recla
*Assistant Examiner*—Charles R. Eloshway
*Attorney, Agent, or Firm*—Don J. Flickinger; Robert A. Parsons; Parsons & Associates

[57] ABSTRACT

A toilet bowl ventilating and deodorizing apparatus comprises an odor collector for extracting air from a toilet bowl, a filter assembly for deodorizing the air extracted from the toilet bowl, and a neck coupling the filter assembly to the odor collector, with the odor collector and the neck supporting the filter assembly adjacent the toilet bowl. The odor collector includes a base attachable to the toilet bowl, an air intake carried by the base and positionable adjacent an interior of the toilet bowl, and a sleeve carried by the base in gaseous communication with the air intake. The filter assembly includes an air duct, an impeller assembly for providing air flow through the apparatus, the air duct is coupled to the filter assembly, and a filter is carried between the impeller assembly and the air duct. A switch is carried by the odor collector for activating the filter assembly, a power source for supplying power to the impeller assembly, and a power circuit coupling the power source to the impeller assembly and the switch.

16 Claims, 13 Drawing Sheets

19
37
39
29
39
22
18
23
30
38
12
24
20
25
28
17
10
15
14
13

38
39
37
19
39
38
29
18
32
24
30
27
33
41
47
10
45
10
48
44
40
34
42
25

20
53
43
17
14
15
28
44
50
12
49

22
23
47
48
17
12
24
41
45
42
14
25
43
27
15
40
28
44
44

FIG. 36
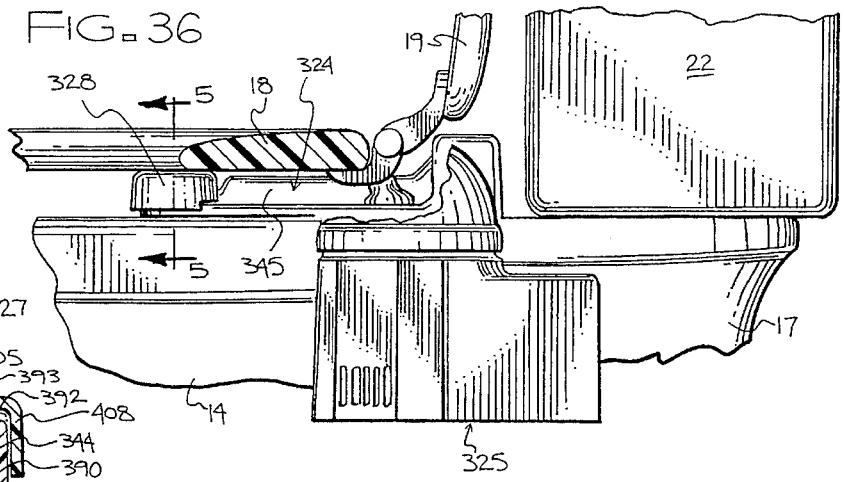
FIG. 41
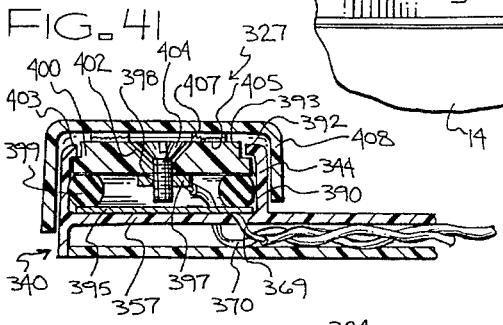
FIG. 39
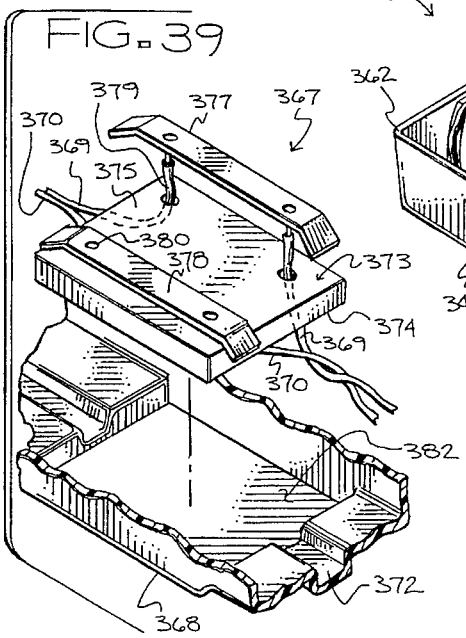
FIG. 37
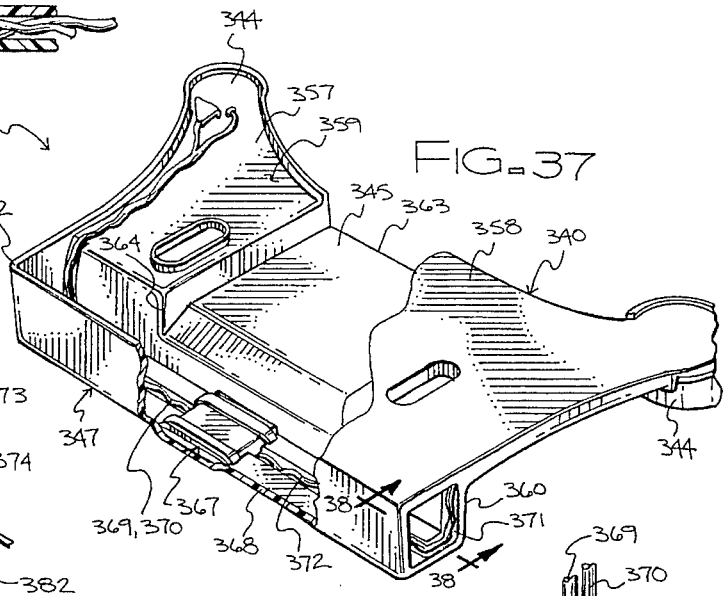
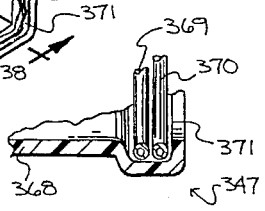
FIG. 38
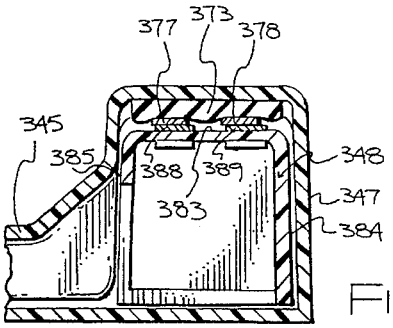
FIG. 40
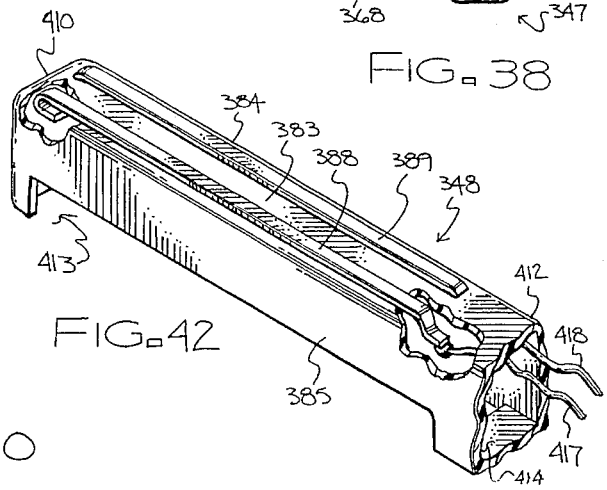
FIG. 42

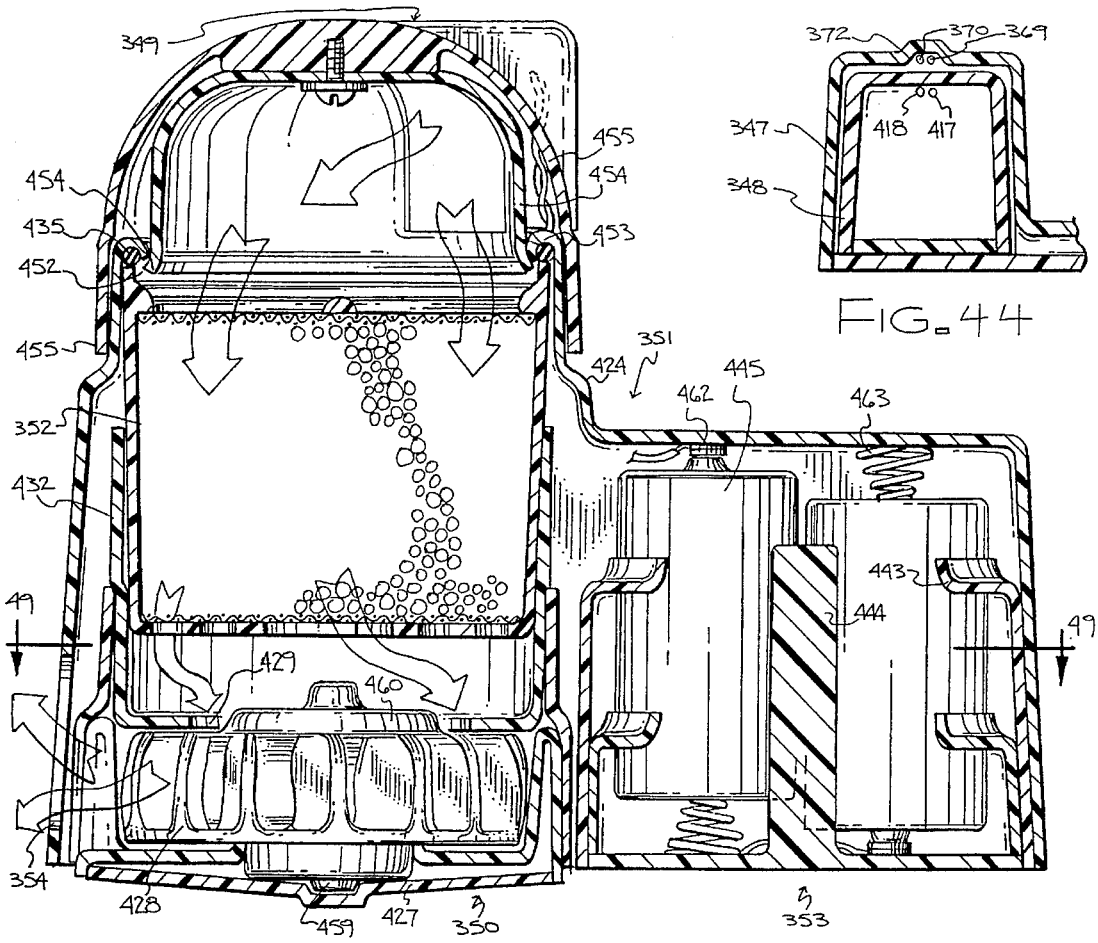
FIG. 47
FIG. 44
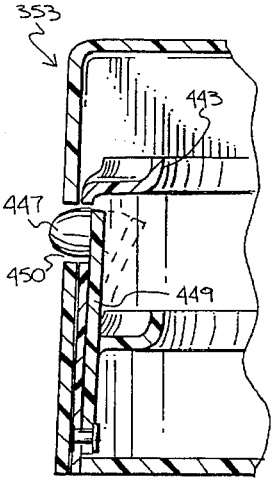
FIG. 46
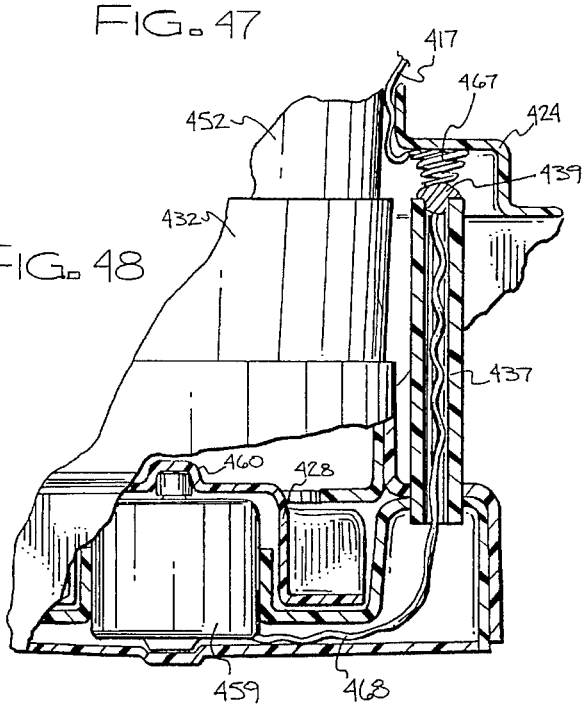
FIG. 48

TOILET BOWL VENTILATING AND DEODORIZING APPARATUS

BACKGROUND OF THE INVENTION

1. Field of the Invention

This invention relates to devices for cleaning air.

More particularly, the present invention relates to air cleaning devices in close association with toilets, for removing malodor from the air.

In a further and more specific aspect, the present invention concerns retrofitting an air cleaning apparatus onto a toilet for cleaning malodorous air within the toilet bowl.

2. The Prior Art

From early times, people have considered their excremental functions private, and accordingly, have moved this event in from the open outdoors, to small closed rooms. While private, these small rooms lack the cleansing breezes of the more natural setting. Attempts have been made to compensate for this deficiency by providing windows, ventilating fans and the like. It has also been discovered that sulfur tends to counteract the offensive odor. Capitalizing on this phenomena, methods have been developed employing sulfur. Some of the simpler methods include lighting matches, candles, and even firing cap guns, although this would seem to draw unnecessary attention to the problem.

While effective, these techniques are not always possible. Many times, the toilets are placed with no access to the outside. In these situations, ducting is required to exchange fresh air with the tainted air. This can be expensive and the ventilation may be slow since the offensive odor is diffused throughout the room and generally evacuated through a small duct. This is less than ideal, since persons in the room will be subjected to the offensive odors for prolonged periods of time. Other situations which do not permit open windows or the use of matches, is in the very small rest rooms of airplanes. Obviously windows cannot be opened, and due to recent regulations, matches cannot be used. Furthermore, the odoriferous air cannot simply be vented outside the aircraft, and certainly cannot be vented into the passenger compartment.

To overcome the problems associated with venting the closed rooms, commonly referred to as bathrooms, containing the toilet, devices directly associated with the toilet have been developed which filter the malodor from the air. Typically, many of the various devices require extensive modifications to be made to the toilet, or a toilet constructed to specification in order to remove the obnoxious air. These modifications include specially constructed toilet seats with air passages, lids and/or bowls.

After the foul air has been drawn from the bowl, it is then necessary to provide treatment devices packaged in a manner which will not detract from the decor of the bathroom. No matter how attractively the exhaust and deodorizing devices are housed, they remain a distraction and are often a nuisance. Generally, these devices are not esthetically pleasing, being large bulky and positioned on the floor next to the toilet. These devices, so placed are tasteless and detract from the overall decor of a bathroom as well being obstructive. Many require an electrical outlet as a power source, which may or may not be conveniently to hand.

It would be highly advantageous, therefore, to remedy the foregoing and other deficiencies inherent in the prior art.

Accordingly, it is an object of the present invention to provide an improved ventilated and deodorized toilet.

Another object of the present invention is to provide a new and improved apparatus for ventilating and deodorizing a toilet.

And another object of the present invention is to provide a ventilating and deodorizing apparatus which can be retrofitted onto a toilet.

Still another object of the present invention is to provide a ventilating and deodorizing apparatus which is adjustable to allow adaptation to substantially any toilet.

Yet another object of the present invention is to provide a ventilating and deodorizing apparatus which may be mounted to a toilet so as to be substantially unnoticeable.

Yet still another object of the present invention is to provide a self contained toilet ventilating and deodorizing apparatus.

A further object of the present invention is to provide a ventilating and deodorizing apparatus which prevents substantially all of the obnoxious odors from escaping the toilet.

And a further object of the present invention is to provide a ventilating and deodorizing apparatus which is easy to install and to maintain.

Yet a further object of the present invention is to provide a ventilating and deodorizing apparatus which is self contained.

And yet a further object of the present invention is to provide a reliable and relatively inexpensive ventilating and deodorizing apparatus for toilets.

SUMMARY OF THE INVENTION

Briefly, to achieve the desired objects of the present invention in accordance with a preferred embodiment thereof, provided is an odor collector mountable on a toilet bowl, for extracting air from the toilet bowl, a filter assembly for deodorizing the air extracted from the toilet bowl, and a neck adjustably coupling the filter assembly to the odor collector, with the odor collector and the neck supporting the filter assembly adjacent the toilet bowl. Further provided is a switch means carried by the odor collector for activating the filter assembly, a power source for supplying power to the assembly, and a power circuit coupling the power source to the filter assembly and the switch means.

More specifically, the odor collector includes a base attachable to the toilet bowl, an air intake carried by the base and positionable adjacent an interior of the toilet bowl, and a sleeve having an open end, carried by the base in gaseous communication with the air intake. The filter assembly includes an air duct having an inlet, an impeller assembly for providing air flow through the apparatus, the air duct is coupled to the filter assembly, and a filter is carried between the impeller assembly and the air duct. The neck has a first end removably and slidably received through the open end of the sleeve, and a second end coupled to the inlet of the air duct.

In accordance with a preferred embodiment thereof, the impeller assembly includes a housing having an inlet and an outlet, coupled to the air duct with the inlet in gaseous communication with an outlet of the air duct. A fan is carried within the housing for producing an air flow through the apparatus, and actuator means for rotating said fan, is carried within the housing. A socket extends from the housing about the inlet, for receiving the filter and for coupling the housing to the air duct.

Further in accordance with an embodiment thereof, the switch means includes a pressure switch carried by the base within a switch housing and covered by a cap over the switch housing and engaging the switch. The pressure switch includes a first contact member, a second contact member, a resilient member separating the first contact member from the second contact member, and a bridging member which couples the first contact member to the second contact member upon compression of the resilient member.

In yet a more specific embodiment, the power circuit includes internal leads, extending from the actuator means, internally to a battery case, and through the air duct, the neck and the odor collector, to the switch means. A contact assembly is mounted within the sleeve, electrically coupled to the switch and corresponding contacts are mounted on the neck, engagable and disengagable with the contact assembly. The corresponding contacts engage the contact assembly over an extended range, permitting inward and outward adjustments of the neck within the sleeve while maintaining electrical contact. The power circuit further includes a contact carried by the air duct and a corresponding contact carried by the housing of the impeller assembly, engagable and disengagable with the contact carried by the air duct.

In a further, more specific aspect, the power source includes a battery case containing a battery. The battery case is removably mountable to the housing of the impeller assembly by mounting brackets serving as contacts between the battery case and the impeller assembly.

The apparatus of the present invention may also include a filter assembly housing having an inlet, an outlet, and an access port. The outlet of the air duct is coupled to the inlet of the filter assembly housing. The filter assembly housing carries the impeller assembly with the socket engaging the outlet of the air duct. The filter assembly housing also carries the power source.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 36 is a partial side plan of the toilet and the toilet ventilating apparatus;

FIG. 37 is a partially cut-away inverted perspective view of an alternate embodiment of an odor collector;

FIG. 38 is a sectional view taken along line 38—38 of FIG. 37;

FIG. 39 is an enlarged cut-away view of a portion of the odor collector of FIG. 37, illustrating a contact assembly;

FIG. 40 is a cross-sectional view of the contact between the odor collector and the neck of a filter assembly inserted therein;

FIG. 41 is a cross-sectional view of an alternate embodiment of a switch assembly;

FIG. 42 is a partial cut-away perspective view of the neck of the filter assembly;

FIG. 44 is a cross-sectional view taken along line 44— 44 of FIG. 43;

FIG. 46 is a sectional view illustrating means for securing the battery case within the housing of filter assembly;

FIG. 47 is a cross-sectional side view of the alternate toilet ventilation apparatus of FIGS. 33–46;

FIG. 48 is a partial sectional view of the impeller assembly;

DETAILED DESCRIPTION OF THE PREFERRED EMBODIMENT

Figure 1:
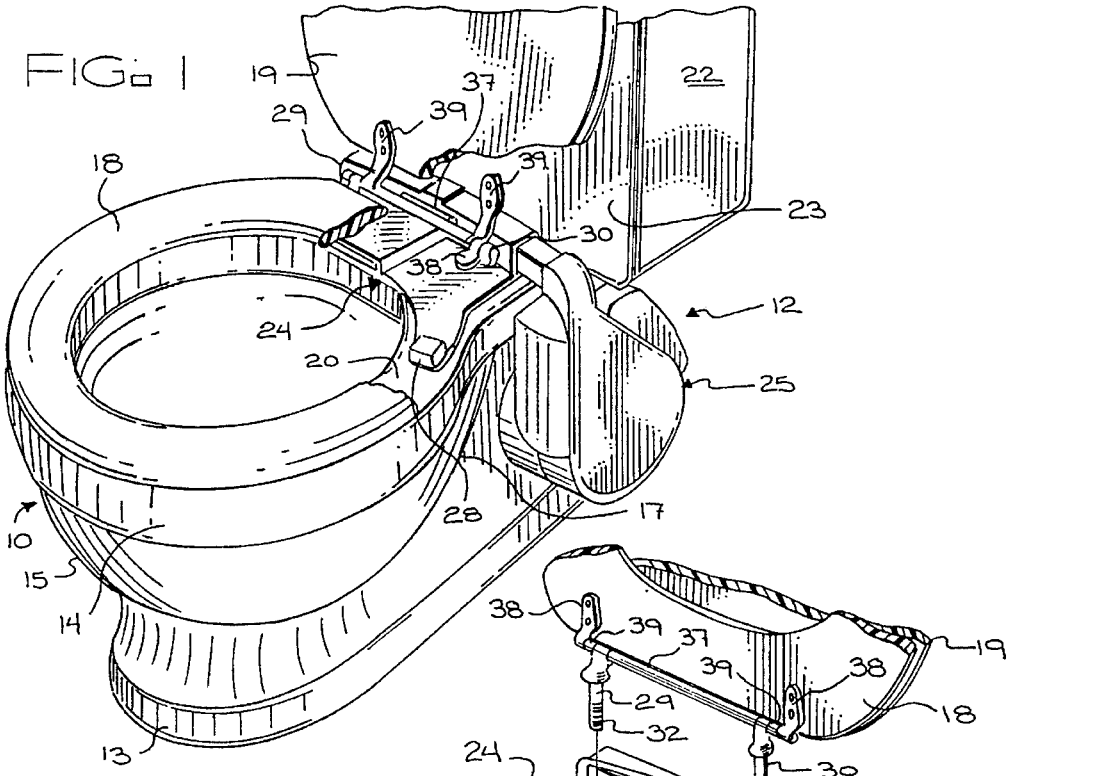
FIG. 1 is a partial perspective view, showing a toilet with the lid in a raised position, and a toilet ventilating apparatus constructed in accordance with the teachings of the present invention, mounted thereon.

Turning now to the drawings in which like reference characters indicate corresponding elements throughout the several views, attention is first directed to FIG. 1 which illustrates a toilet generally designated 10, onto which a toilet ventilating and deodorizing apparatus 12 is mounted. Toilet 10 may be substantially any toilet, and includes a base 13 supporting a toilet bowl 14 having a front 15 and back 17. Front 15 and back 17 of toilet 10 will provide directional reference throughout the ensuing descriptions. A toilet seat 18 and lid 19 are coupled to a top surface 20 of toilet bowl 14 by hinges at back 17 of toilet bowl 14. This hinge arrangement permits seat 18 and lid 19 to be lowered to a horizontal position with respect to top surface 20 of toilet bowl 14 or raised to an upright position with respect to top surface 20. The movement of seat 18 and lid 19 may be accomplished independently. A water tank 22 having a front surface 23, extends upward adjacent back 17 of toilet bowl 14.

Still referring to FIG. 1, toilet ventilating and deodorizing apparatus 12 includes an odor collector 24 mounted on top surface 20 of toilet bowl 14 at back 17, and a filter assembly 25 coupled to odor collector 24 and extending downwardly proximate back 17 of toilet bowl 14, partially concealed by water tank 22. In FIG. 1, seat 18 is in the lowered position wherein it rests on a pair of switches 27 and 28, only one of which is visible, extending from odor collector 24. Lid 19 is shown in the upright position, resting against front surface 23 of water tank 22. To operate toilet ventilating and deodorizing apparatus 12, a person sits on seat 18, compressing at least one of switches 27 and 28, thereby starting operation of filter assembly 25.

Figure 2:
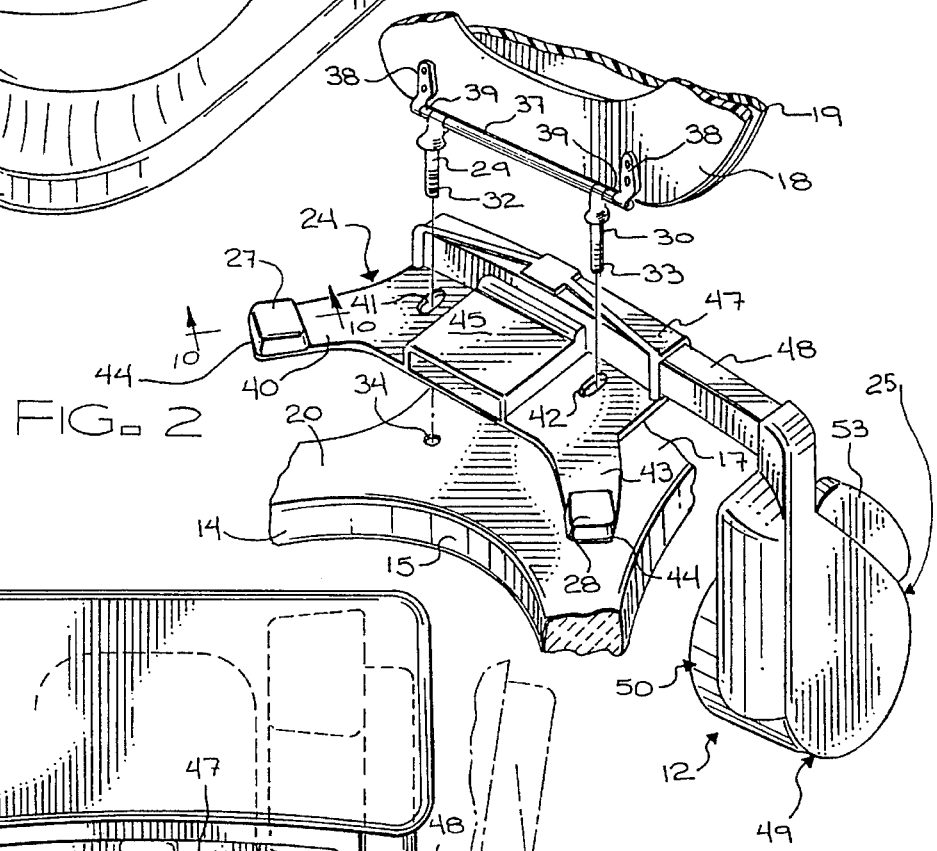
FIG. 2 is a partial exploded perspective view, illustrating how the toilet ventilating apparatus is mounted on a toilet.

The detail of FIG. 2 illustrates the coupling of seat 18, lid 19 and odor collector 24 to toilet bowl 14. A pair of hinge posts 29 and 30 having threaded ends 32 and 33 respectively, are affixed to toilet bowl 14 by inserting threaded ends 32 and 33 through openings 34 and 35 (not visible) in toilet bowl 14 and securing them with nuts (not shown). A pin 37 passes between hinge posts 29 and 30 through a set of seat hinges 38 and a set of lid hinges 39 so that seat 18 and lid 19 may be independently rotated thereabout. The hinge arrangement as depicted is intended to be typical and is not provided as a limitation on the means for practicing the invention.

Still referring to FIG. 2, odor collector 24 includes a base 40, configured to be positioned between top surface 20 of toilet bowl 14 and seat 18. A pair of slots 41 and 42, corresponding to openings 34 and 35 in toilet bowl 14, are formed through base 40 and receive threaded ends 32 and 33 of hinge posts 29 and 30. Shots 41 and 42 are employed to allow forward and rearward adjustments to be made in positioning odor collector 24. Odor collector 24 further includes a pair of opposing legs 43 extending from the front of odor collector 24 and partially along top surface 20 of toilet bowl 14, terminating in switch housings 44 containing switches 27 and 28, an air intake 45 mounted centrally between slots 41 and 42, and a sleeve 47 extending the length of base 40, rearward of and coupled to air intake 45.

Filter assembly 25 is coupled to odor collector 24 by a neck 48 configured to be slidably received by sleeve 47, and includes an air duct 49 extending generally perpendicularly downward from neck 48, an impeller assembly 50 coupled to air duct 49 and a filter 52 (not visible) fitted between impeller assembly 50 and air duct 49. Power is supplied to impeller assembly 50 by batteries contained in a battery case 53 affixed to an outer edge of filter assembly 25.

Figure 3:
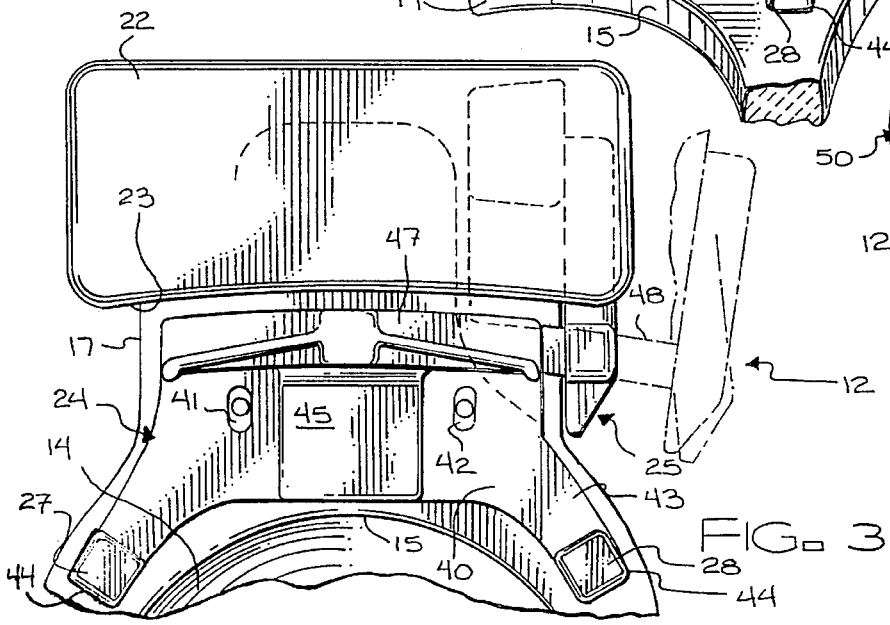
FIG. 3 is a partial top plan illustrating the adjustability of the toilet ventilating apparatus.

Toilet ventilating and deodorizing apparatus 12 is intended to be substantially unnoticeable and blend into the overall appearance of toilet 10. To achieve this desired characteristic, filter assembly 25 is intended to be positioned adjacent back 17 of toilet bowl 14 under water tank 22 as can be seen in FIG. 3. Furthermore, the various components are adjustable since toilet ventilating and deodorizing apparatus 12 is intended to be retrofitted to substantially any toilet. Therefore, to accommodate toilets having different shapes and dimensions, neck 48 is slidably received within sleeve 47 to allow filter assembly 25 to be positioned at varying distance from odor collector 24, filter assembly 25 is pivotally attached to neck 48 allowing filter assembly 25 to be pivoted against the side of substantially any toilet, and slots 41 and 42 permit odor collector 24 to be properly positioned, with air intake 45 positioned to withdraw malodorous air from toilet bowl 14.

Figures 4, 5, 6, 7, 8, 10:
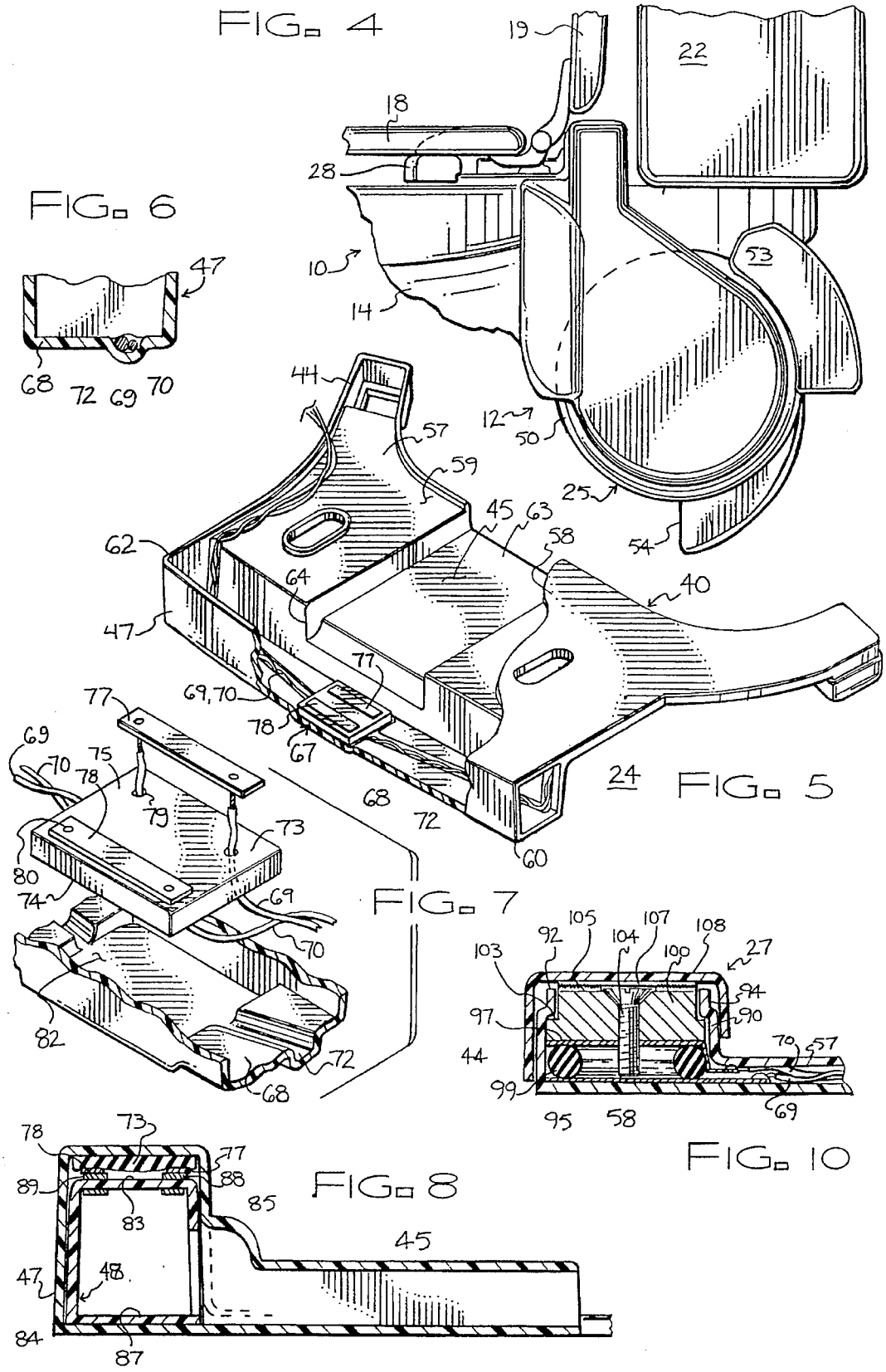
FIG. 4 is a partial side plan of the toilet and the toilet ventilating apparatus.
FIG. 5 is a partially cut-away perspective view of an inverted odor collector.
FIG. 6 is an enlarged cross sectional view of a portion of the odor collector of FIG. 5, showing inset wires.
FIG. 7 is an enlarged cut-away view of a portion of the odor collector of FIG. 5, illustrating a contact assembly.
FIG. 8 is a cross-sectional view of the odor collector with a neck of a filter assembly inserted therein.
FIG. 10 is a cross-sectional view of the switch of FIG. 9 taken along line 10—10 of FIG. 2.

Toilet ventilating and deodorizing apparatus 12 is illustrated in FIG. 4, showing how it neatly and compactly fits against the side of toilet 10, with a large portion inconspicuously located under water tank 22. Battery case 53 unobtrusively couples to the rearward portion of filter assembly 25 under water tank 22. The coupling of battery case 53 will be described in greater detail below. An air outlet 54 from which deodorized air from toilet bowl 14 is expelled, can be seen extending downward from the bottom of impeller assembly 50.

Referring now to FIG. 5, odor collector 24 is illustrated in an inverted position. Base 40 includes a top 57 and a bottom 58 with a space 59 therebetween. A portion of bottom 58 is cut-away to show the inside of base 40. Sleeve 47 can be seen to be a substantially square tube extending the length of the rear of base 40, having an open end 60 for receiving neck 48 and a closed end 62. Air intake 45 extends from the front of base 40 to the back of base 40, having an inlet port 63, which is positioned to withdraw air from toilet bowl 14, and an outlet port 64 coupled in gaseous communication with sleeve 47. Odor collector 24 further includes a contact assembly 67 mounted within sleeve 47, fixed to a top 68 thereof, and a pair of leads 69 and 70 extending from contact assembly 67 through space 59 of base 40 to each of switch housings 44. While two pair of leads 69 and 70 are employed in this embodiment, each extending between one of switches 27 and 28 and contact assembly 67, it will be understood by one skilled in the art that only a single pair of leads 69 and 70 is required, coupled to a single switch. A redundant switch with associated pair of leads is employed to ensure that toilet ventilating and deodorizing apparatus 12 operates when a person sits on seat 18, even if that person sits off center depressing only one switch.

In order for neck 48 to slide freely within sleeve 47, each pair of leads 69 and 70 must be placed so as to avoid obstructing neck 48. As can be seen with additional reference to FIG. 6, leads 69 and 70 are recessed within a channel 72 formed in top 68. In this manner, leads 69 and 70 extend from contact assembly 67 along sleeve 47 to open end 60 and closed end 62 without interfering with neck 48.

Referring specifically to FIG. 7, contact assembly 67 consists of a contact pad 73 having a top surface 74 and bottom surface 75, constructed of a resilient insulating material such as rubber, and a pair of contacts 77 and 78 coupled to bottom surface 75. A pair of openings 79 and 80 are formed in the front and rear of contact pad 73 underneath contacts 77 and 78. Contact pad 73 is partially recessed into a depression 82 formed in top 68, with top surface 74 of contact pad 73 fastened to top 68 of sleeve 47. Each pair of leads 69 and 70 extend from channels 72 into depression 82. Lead 69 from each pair of leads 69 and 70 is received through one of openings 79 from top surface 74 and attached to contact 77, and lead 70 from each pair of leads 69 and 70 is received through one of openings 80 from top surface 74 and attached to contact 78.

Referring now to FIG. 8, neck 48 is shown inserted within sleeve 47. Neck 48 has a generally square cross-section, with a top surface 83, a rearward side 84, a forward side 85, and a bottom 87. A pair of contacts 88 and 89 corresponding to contacts 77 and 78 respectively, extend along top surface 83 (FIG. 11) and engage contacts 77 and 78 when neck 48 is received by sleeve 47. Contact pad 73 insures adequate engagement between contacts 77, 78 and 88, 89 by extending slightly out of depression 82. As neck 48 is inserted into sleeve 47, contacts 77 and 78 engage contacts 88 and 89 and compress contact pad 73 which, being resilient, forces contacts 77, 78 against contacts 88,89.

Figure 9:
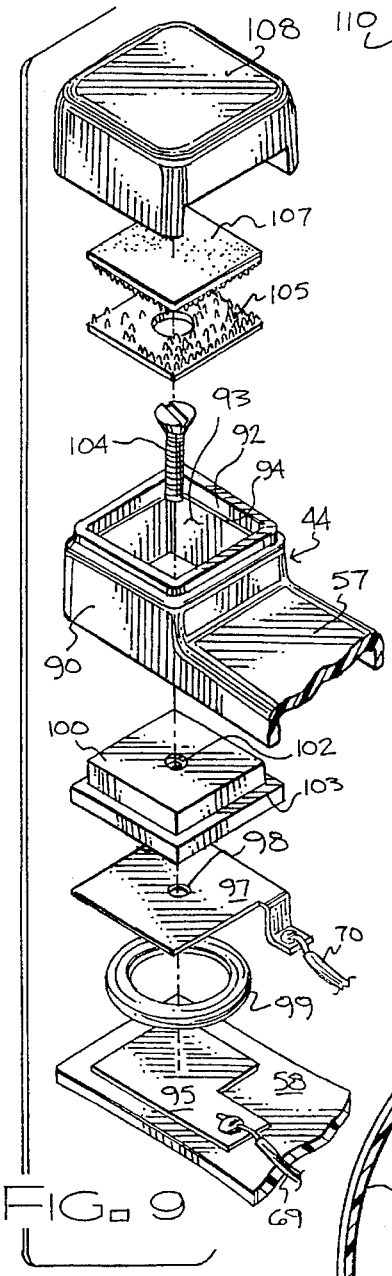
FIG. 9 is an exploded perspective view of a switch assembly.

When neck 48 is inserted into sleeve 47, and contacts 77 and 78 firmly engage contacts 88 and 89, closing of one of switches 27 and 28 starts apparatus 12. Turning now to FIGS. 9 and 10, switch 27 is illustrated. Since switch 27 and switch 28 are identical, only one is described in detail. Switch 27 is mounted on bottom 58 of base 40 within switch housing 44. Switch housing 44 is a substantially square chamber formed from walls 90 extending upward from top 57 of base 40, terminating in a rim 92 defining an opening 93. Intermediate rim 92 and walls 90 is an inward sloping shoulder 94, whose purpose will be discussed presently.

Referring specifically to FIG. 9, a bottom contact strip 95 is mounted on bottom 58 with lead 69 coupled thereto. A top contact strip 97 with lead 70 coupled thereto, and having a bore 98 formed therethrough, is positioned over bottom contact strip 95, separated therefrom by a resilient ring 99, preferably composed of rubber. A compression member 100 having a threaded bore 102 formed therethrough and an outwardly directed shoulder 103 formed around the periphery thereof, is carried by top contact 97 with threaded bore 102 concentric with bore 98. Inwardly directed shoulder 94 of housing 44 engages outwardly directed shoulder 103 of compression member 100, retaining bottom contact 95, ring 99, top contact 97, and compression member 100 within housing 44. A screw 104 extends through an element 105 of an engagement pair and continues through compression member 100, bore 98 of top contact 97 and ring 99, terminating in a spaced apart relationship with bottom contact 95. The positioning of screw 104 with respect to bottom contact 95 may be adjusted by threading screw 104 farther through or unscrewing screw 104 from threaded bore 102 of compression member 100, but it is desirable that the head of screw 104 extend upward past rim 92 of switch housing 44. A cap 108 containing a complemental element 107 of the engagement pair, fits over switch housing 44 in a sliding engagement, secured to compression member 100 by the engaged element 105 and complemental element 107 of the engagement pair. Preferably the engagement pair consists of the hook and loop elements of Velcro®.

Switch 27 is closed by seat 18 pressing against cap 108 with sufficient force, such as when a person is seated thereon. Turning to FIG. 10, it will be seen that if sufficient force is applied to cap 108, compression member 100 is forced downward, compressing resilient ring 99 and bringing screw 104 into contact with bottom contact 95. When this occurs, the gap between bottom contact 95 and top contact 97 is bridged, closing the switch, and coupled lead 69 to 70, which extend back through space 59 of base 40 to contact assembly 67.

Figure 11:
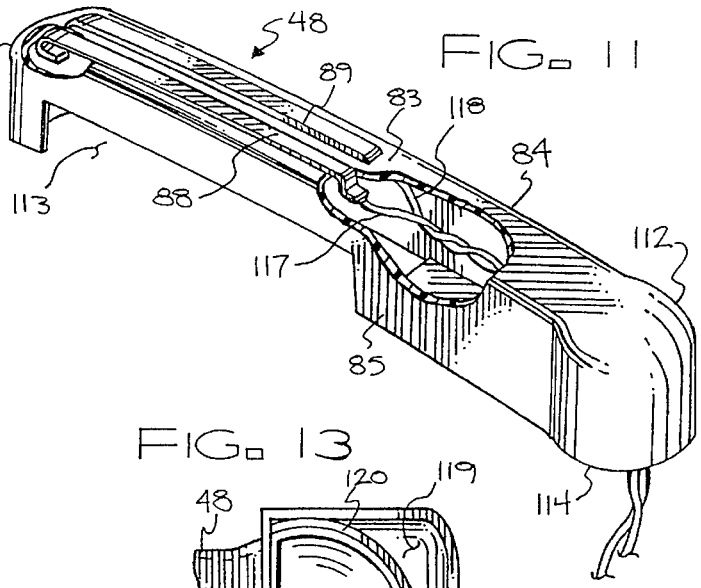
FIG. 11 is a partial cut-away perspective view of the neck of the filter assembly.

Referring now to FIG. 11, neck 48, as discussed previously in connection with FIG. 8, includes top surface 83 carrying contacts 88 and 89, rearward side 84 and forward side 85. Neck 48 further includes an insert end 110, and a pivot end 112. Insert end 110 is received within sleeve 47 as described previously, and pivot end 112 is pivotally coupled to filter assembly 25 and will be discussed infra. An opening 113 is formed in forward side 85 proximate insert end 110, allowing admittance of malodorous air from air intake 45. Opening 113 is somewhat elongate to allow adjustment of neck 48 while maintaining communication between opening 113 and outlet port 64. An opening 114 is formed in pivot end 112, through which malodorous air leaves neck 48 to enter filter assembly 25. A pair of leads 117 and 118 extend through opening 114 into neck 48 and are coupled to an end of contacts 88 and 89 respectively. An opposing end of contacts 88 and 89, positioned proximate insert end 110, is rounded so that contacts 88 and 89 will easily slide onto contact assembly 67 without catching an edge and causing damage.

Figure 13:
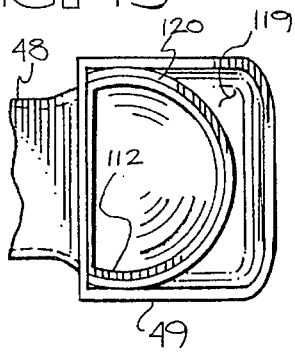
FIG. 13 is a sectional view taken along line 13—13 of FIG. 12.
Figure 12:
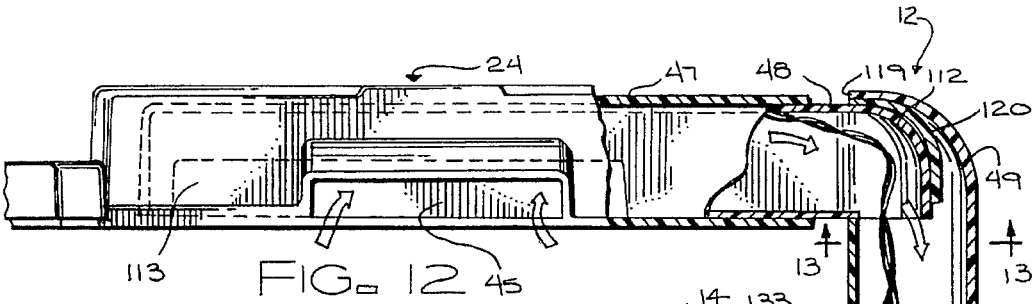
FIG. 12 is a cross-sectional side view of the toilet ventilating apparatus, showing air flow directions.

Odor collector 24 is coupled in gaseous communication with filter assembly 25 by neck 48 extending between sleeve 47 and an inlet 119 of air duct 49, as can be seen with reference to FIG. 12. Operation of impeller assembly 50 draws offensive air from toilet bowl 14 (not shown) into odor collector 24 through air intake 45, and thence through opening 113 into neck 48. With additional reference to FIG. 13, pivot end 112 of neck 48 is received in a socket 120 formed within inlet 119 of air duct 49. Pivot end 112 of neck 48 is rounded to form a substantially sealing engagement with, and permit some rotation within socket 120. Rotation of pivot end 112 is halted by contact between neck 48 and air duct 49. As discussed supra, the rotation of filter assembly 25 with respect to neck 48 permits adjustment to accommodate a wide variety of toilet configurations.

Figure 14:
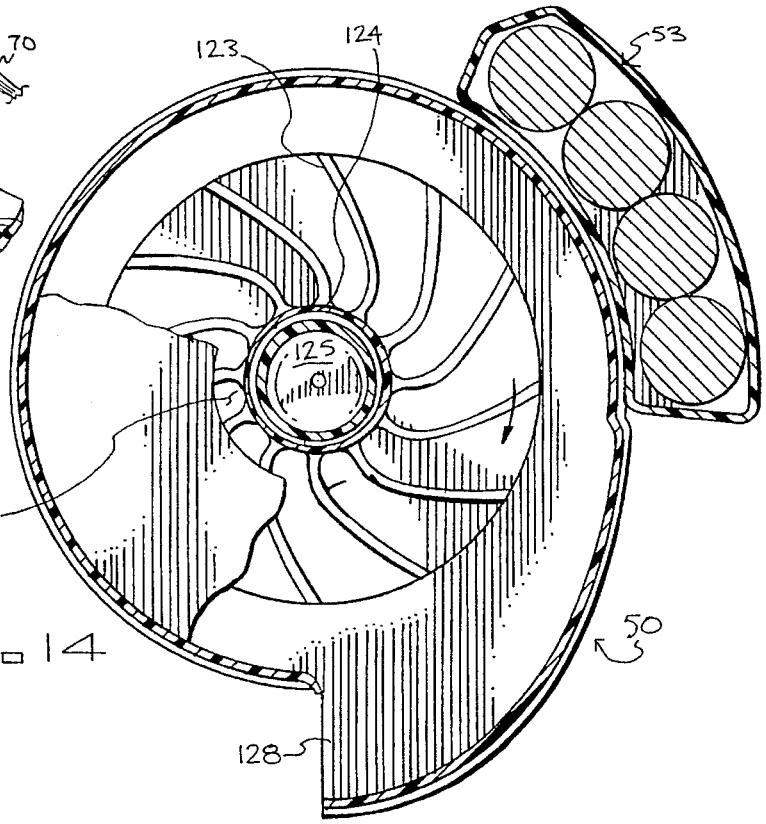
FIG. 14 is a cross-sectional side view of the filter assembly taken along line 14—14 of FIG. 12.

Still referring to FIG. 12, malodorous air progresses through inlet 119 into air duct 49, out outlet 121 of air duct 49, and is subsequently drawn through filter 52, where the malodor is removed from the air, into impeller assembly 50. With additional reference to FIG. 14, impeller assembly 50 consists of a housing 122 enclosing a fan 123 having a hub 124. Fan 123 is driven by a motor 125 positioned in hub 124, powered by battery case 53 coupled to the outer surface of housing 122. Rotation of fan 123 draws filtered air through an opening 127 in housing 122 positioned adjacent to hub 124, and expels the filtered air through an outlet 128.

Figure 15:
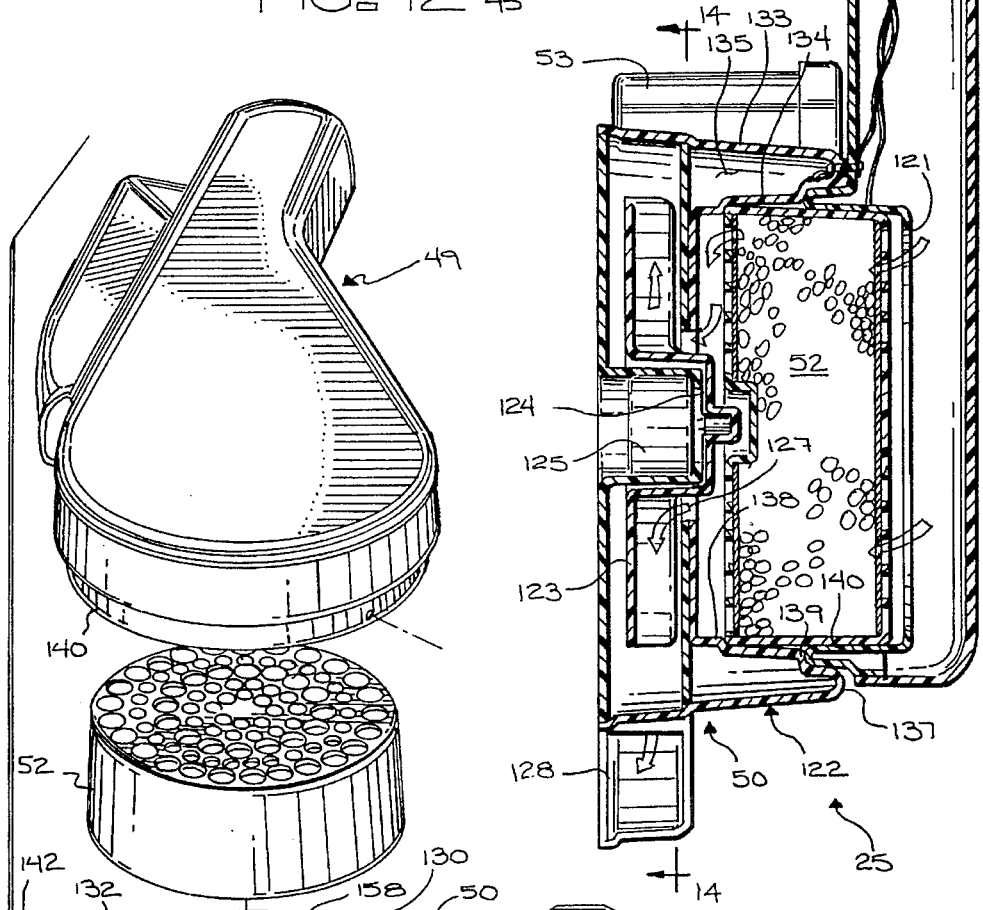
FIG. 15 is an exploded perspective view, showing the filter assembly.
Figure 15:
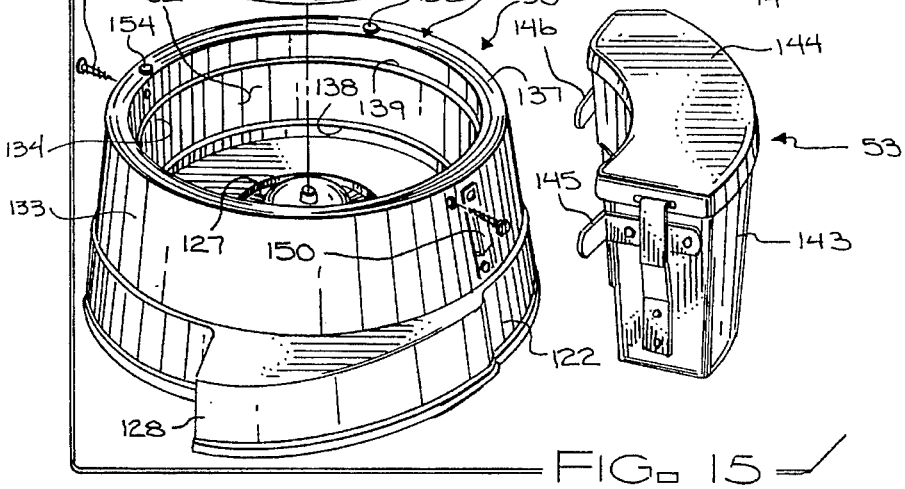

Referring now to FIG. 15, impeller assembly 50 further consists of a socket 130 extending from housing 122 and defining a receptacle 132 over opening 127. Socket 130 has an outer wall 133 and an inner wall 134 defining a space 135 therebetween. Inner wall 134 slopes outward to join outer wall 133 at a rim 137, opposite housing 122, and further includes a radially inwardly directed shoulder 138 proximate housing 122 for supporting filter 52, and a radially inwardly directed shoulder 139 proximate rim 137 for supporting air duct 49. Filter 52 is received within receptacle 132 of socket 130, covering opening 127. The slope of inner wall 134 provides a tight fit around the periphery of filter 52, preventing air flow around same. A ridge 140 extends from air duct 49 encircling outlet 121, configured to be received by socket 130 and engage shoulder 139. Air duct 49 is held securely in place by screws 142 inserted through socket 130 into ridge 140.

Figure 18:
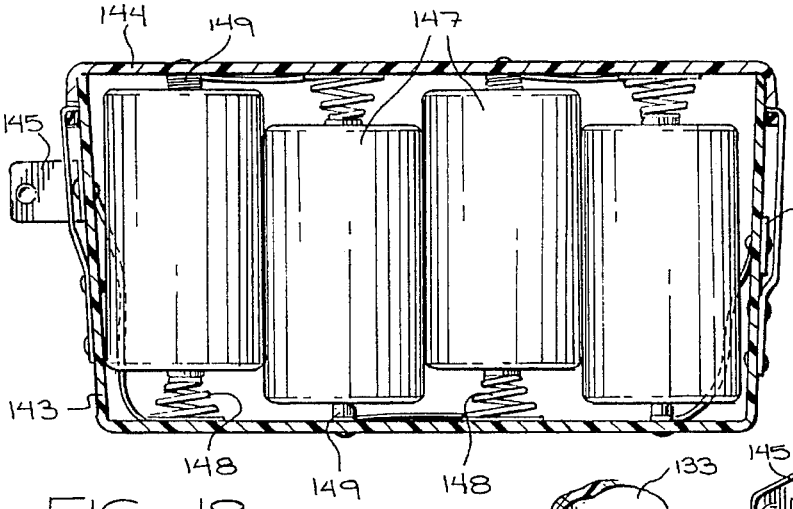
FIG. 18 is a cross-sectional view of the battery case.

A battery case 53 is attached to outer wall 133 of socket 130, providing power to operate motor 125. Battery case 53 includes a body 143 for holding batteries, a cover 144 closing body 143, and clips 145 and 146 for coupling battery case 53 to socket 130. With additional reference to FIG. 18, battery case 53 preferably holds four D cell batteries 147, and includes conventional negative and positive terminal contacts 148 and 149 respectively, for receiving batteries 147, with the negative terminal contacts being compression coils to insure a secure fit and connection. Negative and positive terminal contact 148 and 149 are coupled in a conventional manner, and terminate at clips 145 and 146 respectively.

Figure 19:
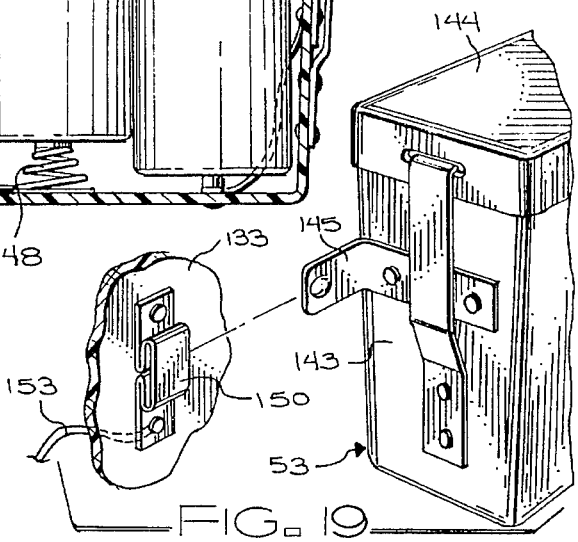
FIG. 19 is a partial perspective view illustrating a first electrical and mechanical coupling between the battery case and the impeller assembly.
Figure 20:
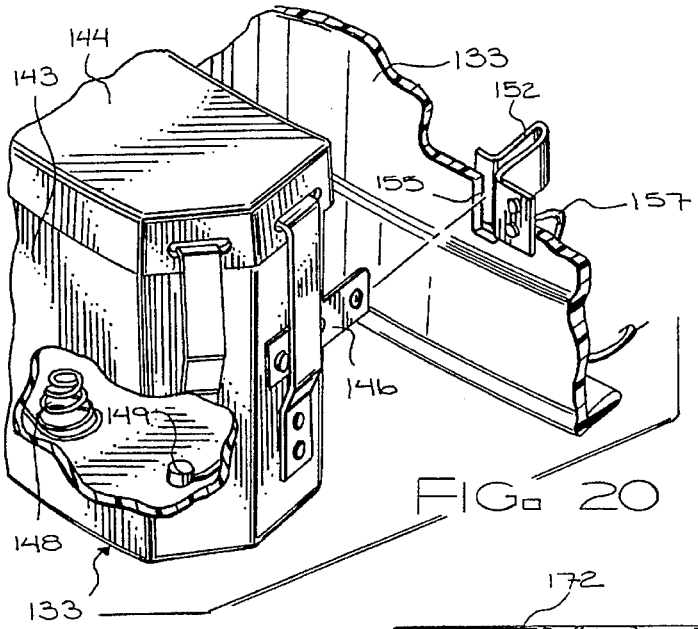
FIG. 20 is a partial perspective view illustrating a second electrical and mechanical coupling between the battery case and the impeller assembly.

Still referring to FIG. 15, clips 145 and 146 function to mechanically and electrically coupled battery case 53 to impeller assembly 50. Clips 145 and 146 are configured to be received by brackets 150 and 152 carried by outer wall 133 of socket 130 respectively. Details of the connection between battery case 53 and impeller assembly 50 can be seen with additional reference to FIGS. 19 and 20. FIG. 19 illustrates clip 145 extending outward from an end of battery case 53, to be received within bracket 150, substantially parallel to outer wall 133. A lead 153 is coupled to bracket 150, extending through space 135 between inner wall 134 and outer wall 133, and terminating in a contact 154 extending from rim 137 (FIG. 15). FIG. 20 illustrates clip 146, extending parallel to battery case 53, being plugged into bracket 152 through a slot 155 formed in outer walls 133. A lead 157 is coupled to bracket 152, extending through space 135 between inner wall 134 and outer wall 133, and terminating in a contact 158 extending from rim 137 (FIG. 15).

Figure 17:
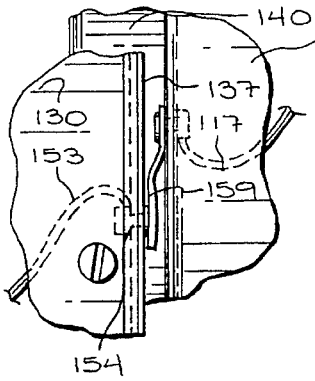
FIG. 17 is a partial view illustrating electrical contact between a impeller assembly and an the air duct.
Figure 16:
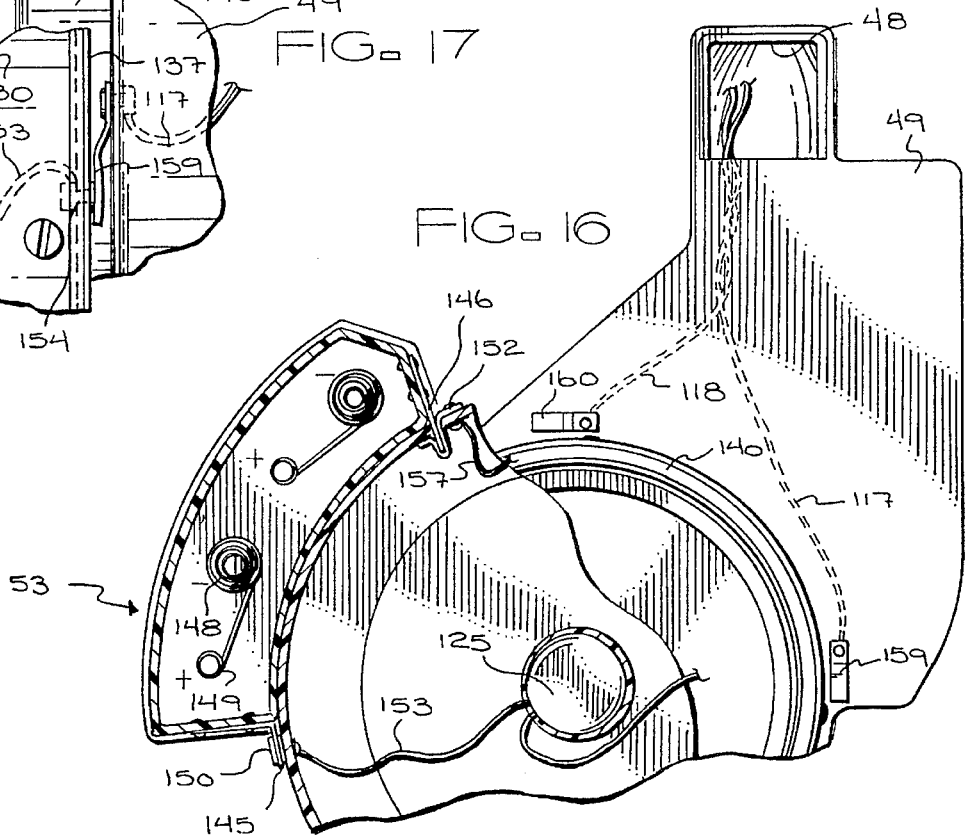
FIG. 16 is a partial cut-away view of the filter assembly and battery case.

The details of the electrical connections between battery case 53 and impeller assembly 50, and between impeller assembly 50 and air duct 49 are shown in FIG. 16. Battery case 53 is easily attached to impeller assembly 50 by sliding clip 145 into bracket 150, then plugging clip 146 into bracket 152 with battery case 53 flush against outer wall 133. Lead 153 extends from bracket 150 to motor 125 then terminates in contact 154 (FIG. 15). Lead 157 extends from bracket 152 and terminates in contact 158 (FIG. 15). Air duct 49 includes spring contacts 159 and 160, corresponding to contacts 154 and 158 respectively, attached adjacent ridge 140 and placed so as to engage contacts 154 and 158 respectively when air duct 49 is coupled to impeller assembly 50. Details of the connection between contacts 154 and 158 and spring contacts 159 and 160 are shown in FIG. 17. Spring contacts are preferred to insure a solid connection.

Figure 21:
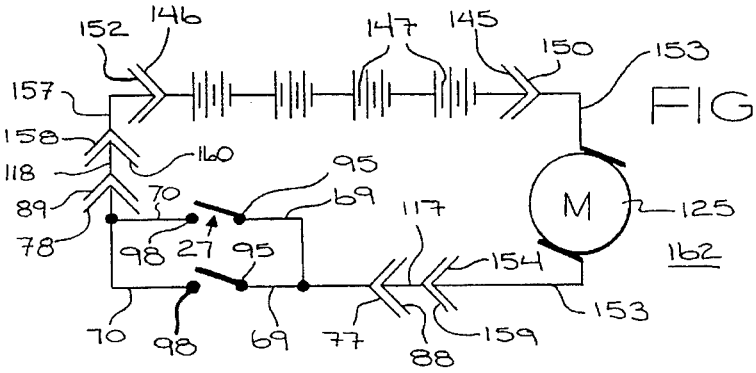
FIG. 21 is a circuit diagram of the toilet ventilating apparatus.

A diagrammatic representation of an operating circuit 162 of toilet ventilating and deodorizing apparatus 12 is illustrated in FIG. 21. Switches 27 and 28 having contacts 95 and 98 are coupled in parallel, each having leads 70 extending from contacts 98 which terminate at contact 78, and leads 69 extending from contacts 95 which terminate at contact 77. Progressing from switches 27 and 28 in a clock wise direction, contact 78, found in sleeve 47, is coupled to contact 89 of neck 48 when neck 48 is inserted into sleeve 47. Lead 118 extends from contact 89, terminating in spring contact 160 mounted on air duct 49. Spring contact 160 disengageably engages contact 158 on rim 137 when air duct 49 is fitted to impeller assembly 50. Lead 157 extends from contact 158 and is disengageably coupled to the positive terminal of batteries 147 by mounting battery case 53 onto impeller assembly 50, thereby engaging contacts 152 and 146. The negative terminal of batteries 147 are coupled to motor 125 through lead 153 when battery case 53 is mounted, coupling contacts 145 and 150. Lead 153 then couples motor 125 to switches 27 and 28 by two disengageable couplings. Lead 154 terminates in contact 154 on rim 137 which, when air duct 49 is fitted to impeller assembly 50, engages spring contact 159. Lead 117, extending from contact 159 terminates in contact 88 of neck 48. Contact 88 engages contact 77 of sleeve 47, coupling lead 117 to leads 69. Upon closing of either or both switches 27 and 28, circuit 162 is completed and motor 125 is powered.

Detachable coupling are provided, coupling each of the removable parts, specifically sleeve 47, neck 48, air duct 49, impeller assembly 50 and battery case 53, so that an individual can easily install system 12 with little thought to wiring, battery case 53 can be removed for battery changes, and air duct 49 can be removed to change or clean filter 52 without the need to worry about disconnecting wiring. Furthermore, in this manner, the wiring is entirely contained within system 12 to enhance appearance and prevent accidental disconnections.

Figure 22:
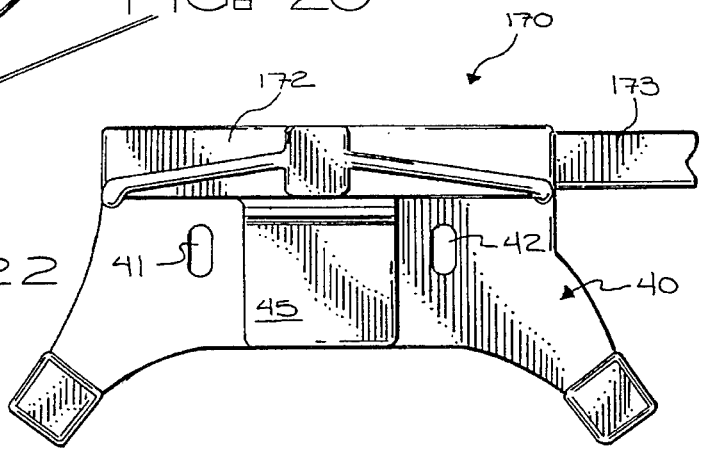
FIG. 22 is a top plan view of the odor collector.

Turning now to FIG. 22, an alternate embodiment of an odor collector generally designated 170 is illustrated. Odor collector 170 is generally identical to and shares in common with odor collector 24, elements, including base 40, air intake 45 and slots 41 and 42. In contrast, odor collector 170 differs from odor collector 24 in that a sleeve 172 is substantially straight for receiving a straight neck 173, as opposed to the slightly convex sleeve 47 and corresponding neck 48 of odor collector 24.

Figure 24:
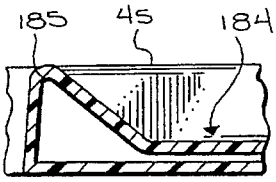
FIG. 24 if a cross-sectional view taken along line 24— 24 of FIG. 23.
Figure 23:
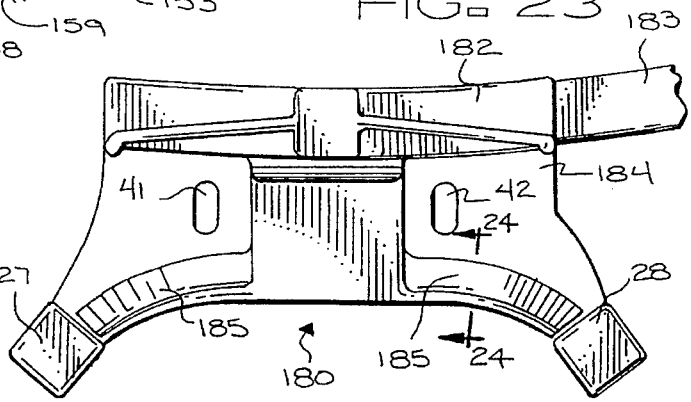
FIG. 23 is a top plan view of an alternate odor collector.

Referring now to FIG. 23, a further embodiment of an odor collector generally designated 180 is illustrated. Odor collector 180 is generally identical to and shares in common with odor collector 24, elements, including air intake 45 switches 27 and 28, and slots 41 and 42. In contrast, odor collector 180 differs from odor collector 24 in that a sleeve 182 is concave for receiving a corresponding neck 183, as opposed to the slightly convex sleeve 47 and corresponding neck 48 of odor collector 24. Furthermore, with additional reference to FIG. 24, odor collector 180 includes a base 184 having a raised air dam 185 extending along the inner edge thereof, between switches 27,28 and air intake 45. Air dam 185 prevents air outside bowl 14 from being drawn between seat 18 and top surface 20 into air intake 45.

Figure 25:
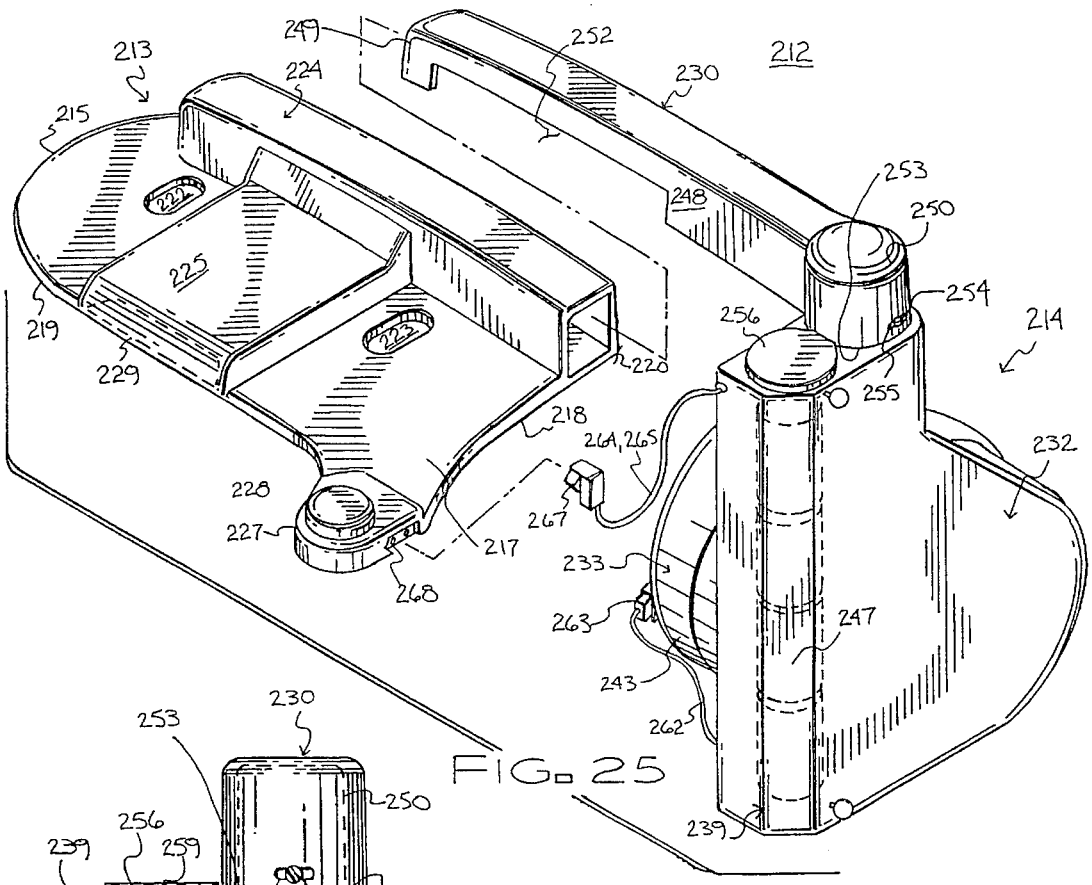
FIG. 25 is a partial exploded view of an alternate toilet ventilating apparatus constructed in accordance with the teachings of the present invention.
Figure 26:
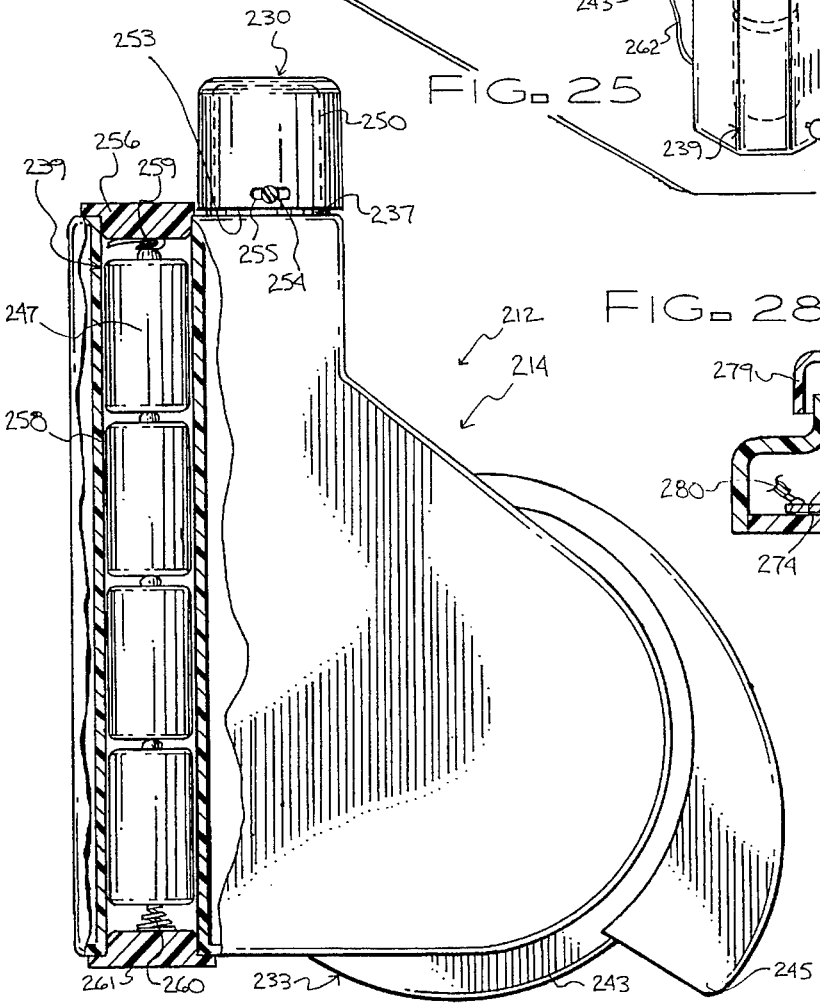
FIG. 26 is a partial cut-away side view of the toilet ventilating apparatus of FIG. 25, illustrating a battery compartment.

An alternate embodiment of a toilet ventilating and deodorizing apparatus generally designated 212, is illustrated in FIGS. 25 and 26. Apparatus 212 is substantially similar to apparatus 12 including an odor collector 213 and a filter assembly 214, mounted onto a toilet in a manner generally identical to that discussed above in connection with apparatus 12, and will not be discussed in great detail here.

Odor collector 213 includes a base 215 having a top surface 217, a bottom surface 218, a front edge 219 and a back edge 220. Base 215 is coupled to a toilet by hinge posts (not shown) extending through slots 222 and 223 formed through base 215. Base 215 further includes a sleeve 224 extending along back edge 220 on top surface 217, an air intake 225 extending from front edge 219 between slots 222 and 223 and abutting sleeve 224, and a tab 227 extending from front edge 219 carrying a switch 228. Apparatus 212 employs a single switch 228 instead of two as was employed in apparatus 212 for purposes of illustration. Air intake 225 has an inlet port 229 formed through base 215 from bottom surface 218, and extending upward into air intake 225. One skilled in the art will understand that while inlet port 229 is directed downward in this embodiment, an inlet port may be used extending horizontally inward from the front of the odor collector as was shown in apparatus 12.

Filter assembly 214 is coupled to odor collector 213 by a neck 230 configured to be slidably received by sleeve 224, and includes an air duct 232 extending generally perpendicularly downward from neck 230, an impeller assembly 233 coupled to air duct 232 and a filter (not visible) fitted between impeller assembly 233 and air duct 232 in a manner generally similar to that described above in connection with embodiment 12. Impeller assembly 233 and air duct 232 are generally similar to impeller assembly 50 and air duct 49 of apparatus 12, and are therefore not described in detail.

Air duct 232 includes an inlet (not visible) defined by an extension 237, and an outlet (not visible). Air duct 232 further includes a battery case 239 which will be discussed in more detail below. Impeller assembly 233 includes a fan, and a motor (not visible) which are generally identical to that described above, contained in a housing 243 having an inlet 244 (not visible) and an outlet 245. The motor driving the fan is powered by batteries 247 contained in battery case 239. Air flow through apparatus 212 is generally similar to that described above, and is therefore omitted here.

Sleeve 224 is in gaseous communication with air intake 225, and receives neck 230. Neck 230 is a generally tubular member having a forward side 248, an insert end 249 and a pivot end 250 extending from filter assembly 214. Insert end 249 is received within sleeve 224 as described previously, and pivot end 250 is pivotally coupled to filter assembly 214 and will be discussed infra. An opening 252 is formed in forward side 248 proximate insert end 249, allowing admittance of malodorous air from air intake 225. Opening 252 is somewhat elongate to allow adjustment of neck 230 while maintaining communication between opening 252 and air intake 225. An opening 253 is formed in pivot end 250, through which malodorous air leaves neck 230 to enter filter assembly 214.

Toilet ventilating and deodorizing apparatus 212 is intended to be substantially unnoticeable and blend into the overall appearance of a toilet. To achieve this desired characteristic, filter assembly 214 is intended to be positioned adjacent the back of a toilet bowl under the water tank as was discussed previously in connection with apparatus 12. Furthermore, the various components are adjustable since toilet ventilating and deodorizing system 212 is intended to be retrofitted to substantially any toilet. Therefore, to accommodate toilets having different shapes and dimensions, neck 230 is slidably received within sleeve 224 to allow filter assembly 214 to be positioned at varying distance from odor collector 213, filter assembly 214 is pivotally attached to neck 230 allowing filter assembly 214 to be pivoted against the side of substantially any toilet, and slots 222 and 223 permit odor collector 213 to be properly positioned, with air intake 225 in communication with a toilet bowl.

Operation of impeller assembly 233 draws offensive air from the toilet bowl (not shown) into odor collector 213 through air intake 225, and thence through opening 252 into neck 230. Pivot end 250 of neck 230 is received over extension 237 extending from the top of air duct 232 (visible in FIG. 26), defining an inlet (not visible). Pivot end 250 of neck 230 is rounded to form a substantially sealing engagement with, and permit some rotation about extension 237. Rotation of pivot end 250 is limited by a set screw 254 extending through a slot 255 formed in pivot end 250 into extension 237. Rotation of neck 230 is limited by the length of slot 255 which moves about set screw 254. As discussed supra, the rotation of filter assembly 214 with respect to neck 230 permits adjustment to accommodate a wide variety of toilet configurations. Malodorous air progresses through air duct 232 and is subsequently drawn through the filter, where the malodor is removed from the air, into impeller assembly 233 and is expelled from outlet 245.

Power is supplied to impeller assembly 233 by batteries 247 held in battery case 239 formed along an edge of air duct 232. Battery case 239 consists of a tubular body 258 running vertically along the side of air duct 232 configured to contain batteries 247 stacked end to end. Tubular body 258 preferably includes a top end cap 256 carrying a positive terminal contact 259 and closing the top of tubular body 258, and a bottom end cap 261 carrying a negative terminal contact 260 and closing the bottom of tubular body 258. A lead 262 extends from negative terminal contact 260, and is coupled to the motor in housing 243 by a releasable coupling 263. A lead 264 and 265 extends from the motor (not shown) and positive terminal contact 259 respectively, and terminate in a connector 267. Switch 228 carried on tab 227 of base 215 includes a connector 268 which receives connector 267, coupling switch 228 into the circuit. While external leads are shown in this embodiment, one skilled in the art will understand that internal wiring, such as those described in embodiment 12 above, may be employed.

Figure 28:
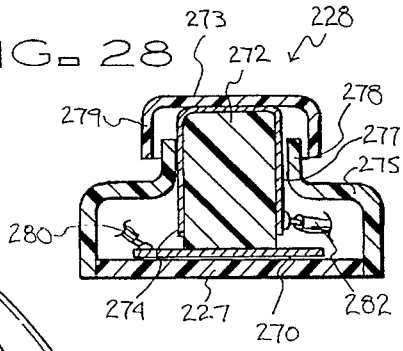
FIG. 28 is a cross-sectional view of the switch illustrated in FIG. 27.
Figure 27:
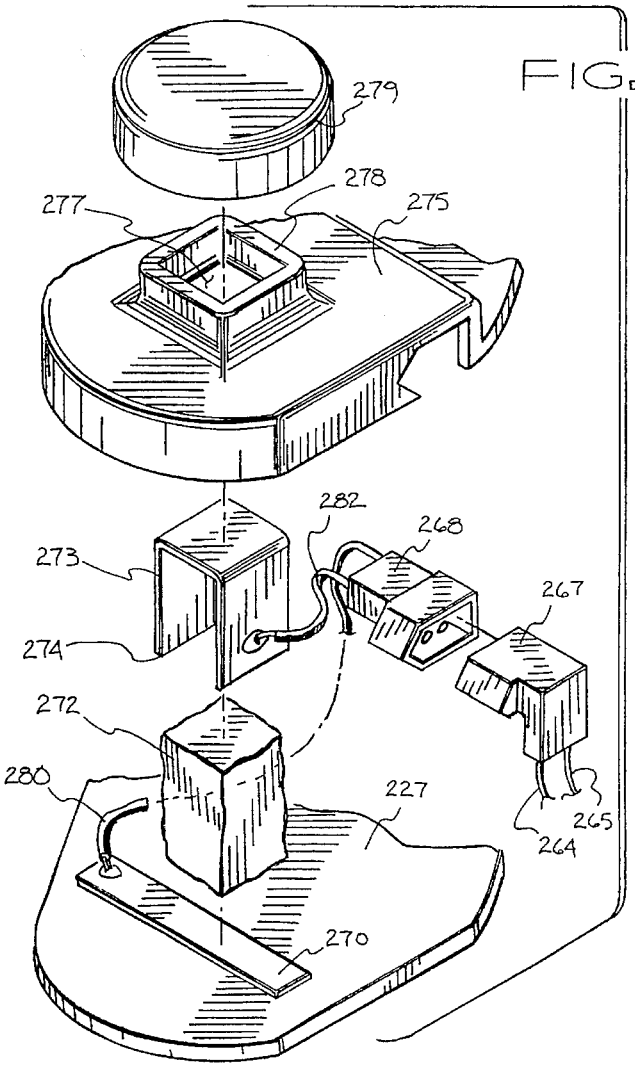
FIG. 27 is an exploded perspective view of a switch assembly.

Referring to FIGS. 27 and 28, switch 228 includes a contact strip 270 mounted onto tab 227. A block 272 of resilient material is carried upon contact strip 270 and extends in a vertical direction. A horseshoe contact 273 is received about the upper portion of block 272 with lower ends 274 spaced apart from contact strip 270 when switch 228 is open. A housing 275 having an opening 277 defined by an upwardly directed rim 278 is mounted onto tab 227, covering contact strip 270, with block 272 and horseshoe contact 273 projecting upward through opening 277. A cover 279 engages horseshoe contact 273 and extends down terminating above housing 275. Application of a downward force to cover 279, such as by engagement with a toilet seat, compresses block 272 allowing contact between lower ends 274 of horseshoe contact 273 and contact strip 270, closing switch 228. Leads 280 and 282 extend from contact strip 270 and horseshoe contact 273 respectively, terminating in connector 268.

In contrast to apparatus 12, an external connection is made between switch 228 and batteries 247. While installation of apparatus 212 requires the additional step of coupling connectors 267 and 268, manufacturing the apparatus with external leads and connections is less costly than internal leads and connectors.

Figure 29:
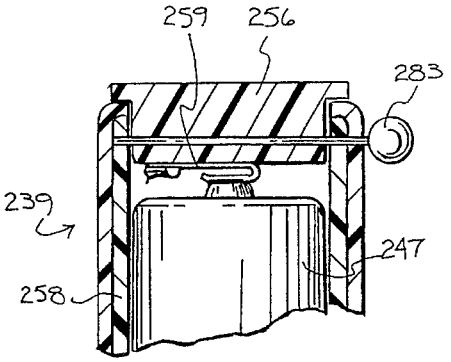
FIG. 29 is a partial cross-sectional view of the top of the battery compartment of FIG. 26.
Figure 30:
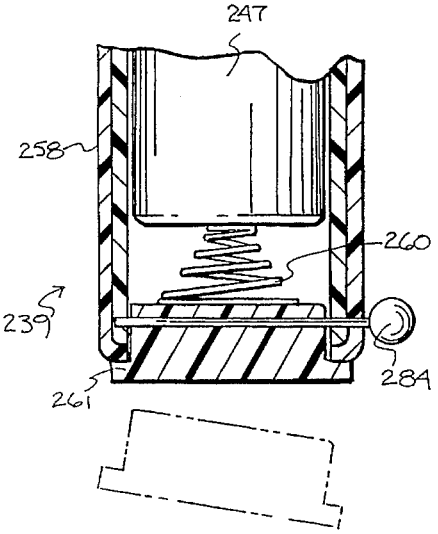
FIG. 30 is a partial cross-sectional view of the bottom of the battery compartment of FIG. 26.

Finally, removal and insertion of batteries 247 in apparatus 212 may be simplified by securing end caps 256 and 261 in tubular body 258 using pins 283 and 284 as illustrated in FIG. 29 and 30. Referring specifically to FIG. 29, pin 283 extends through tubular body 258 into top end cap 256. To install batteries 247, pin 283 is removed, allowing removal of cap 256. Batteries 247 are then simply dropped into tubular body 258 and cap 256 replaced, secured by pin 283. Referring specifically to FIG. 30, pin 284 extends through tubular body 258 into bottom end cap 261. To remove batteries 247, pin 284 is removed, allowing removal of cap 261. Batteries 247 will then simply dropped out of tubular body 258. Cap 261 is then replaced and secured by pin 284.

Figure 31:
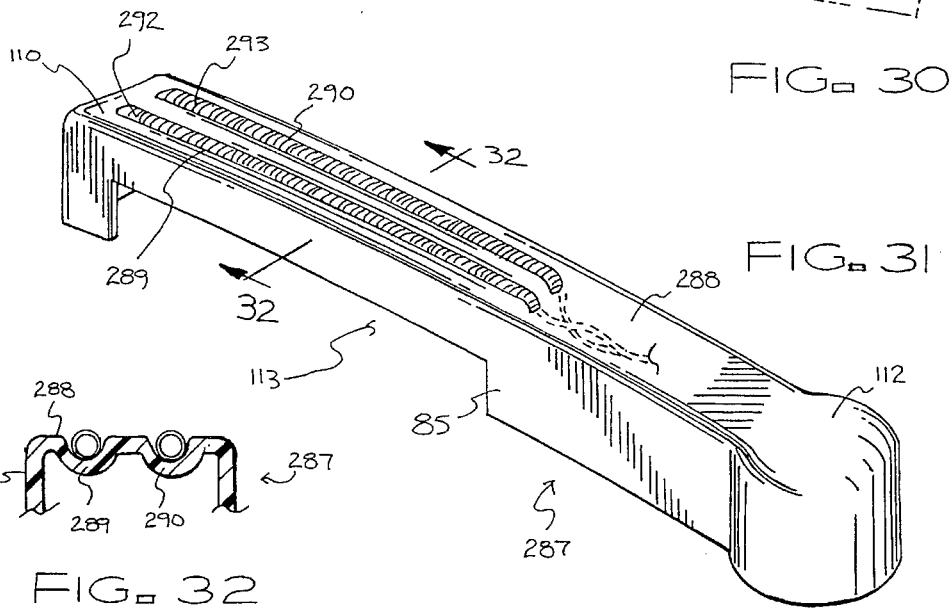
FIG. 31 is a perspective view illustrating an alternate neck.
Figure 32:
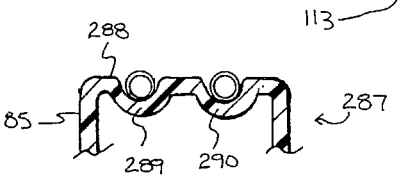
FIG. 32 is a cross-sectional view taken along line 32— 32 of FIG. 31.

An alternate embodiment of a neck generally designated 287 is illustrated in FIGS. 31 and 32. In general similarity to previously described embodiment 48, the immediate embodiment includes in common, an insert end 110, a pivot end 112, and a forward side 85 having an opening 113, other commonalties will be readily apparent to one skilled in the art.

In contrast to neck 48, neck 287 includes a top surface 288 in which parallel channels 289 and 290 are formed. A pair of contacts 292 and 293 analogous to contacts 88 and 89 are partially recessed within channels 289 and 290 respectively. Contacts 292 and 293 are constructed of coiled conductive material imparting a rough surface and resilience to the portion extending out of channels 289 and 290, differing from the planar strips of contacts 88 and 89. The roughness helps remove oxidation from the opposing contacts in the sleeve, and the resilience allows compression of the contacts insuring a good connection.

Figure 33:
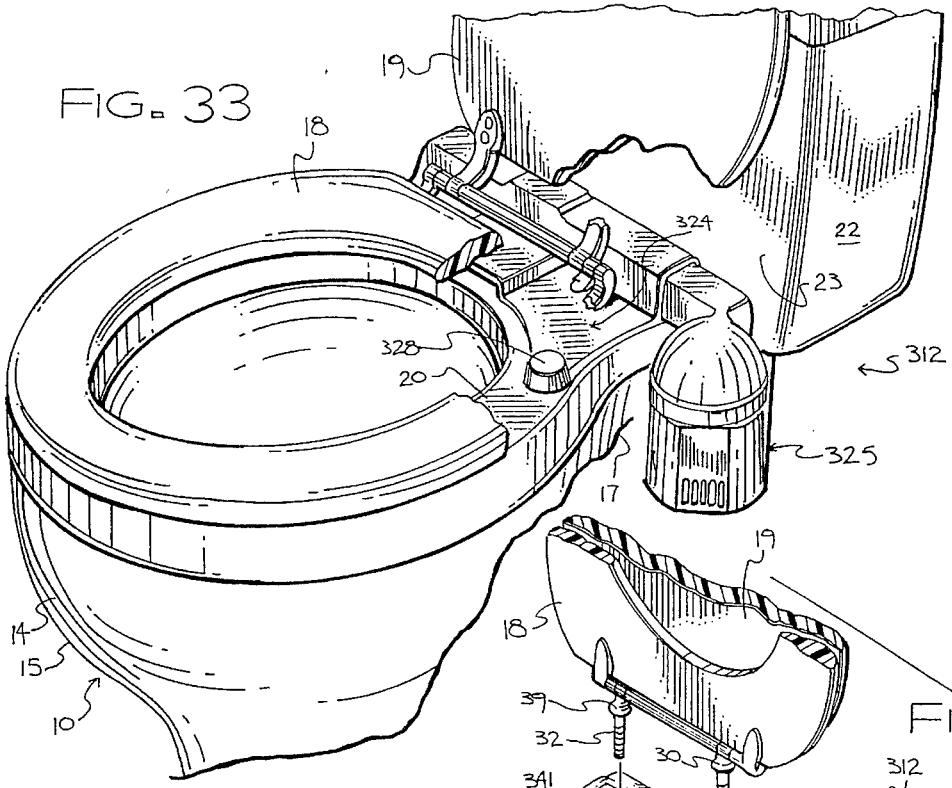
FIG. 33 is a partial perspective view, showing a toilet with the lid in a raised position, and an alternate embodiment of a toilet ventilating apparatus constructed in accordance with the teachings of the present invention, mounted thereon.

An alternate embodiment of a toilet ventilating and deodorizing apparatus generally designated 312 is illustrated in FIGS. 33. Apparatus 312 is illustrated mounted on toilet 10 replacing apparatus 12. Toilet 10 has been described above as including toilet bowl 14, having front 15 and back 17, toilet seat 18 and lid 19 coupled to top surface 20 of toilet bowl 14 by hinges at back 17 of toilet bowl 14, and a water tank 22 having a front surface 23. Front 15 and back 17 of toilet 10 will again provide directional reference throughout the ensuing descriptions.

Still referring to FIG. 33, toilet ventilating and deodorizing apparatus 312 includes an odor collector 324 mounted on top surface 20 of toilet bowl 14 at back 17, and a filter assembly 325 coupled to odor collector 324 and extending downwardly proximate back 17 of toilet bowl 14, partially concealed by water tank 22. In FIG. 33, seat 18 is in the lowered position wherein it rests on a pair of switches 327 and 328, only one of which is visible, extending from odor collector 324. lid 19 is shown in the upright position, resting against front surface 23 of water tank 22. To operate toilet ventilating and deodorizing apparatus 312, a person sits on seat 18, closing at least one of switches 327 and 328, thereby starting operation of filter assembly 325.

Figure 34:
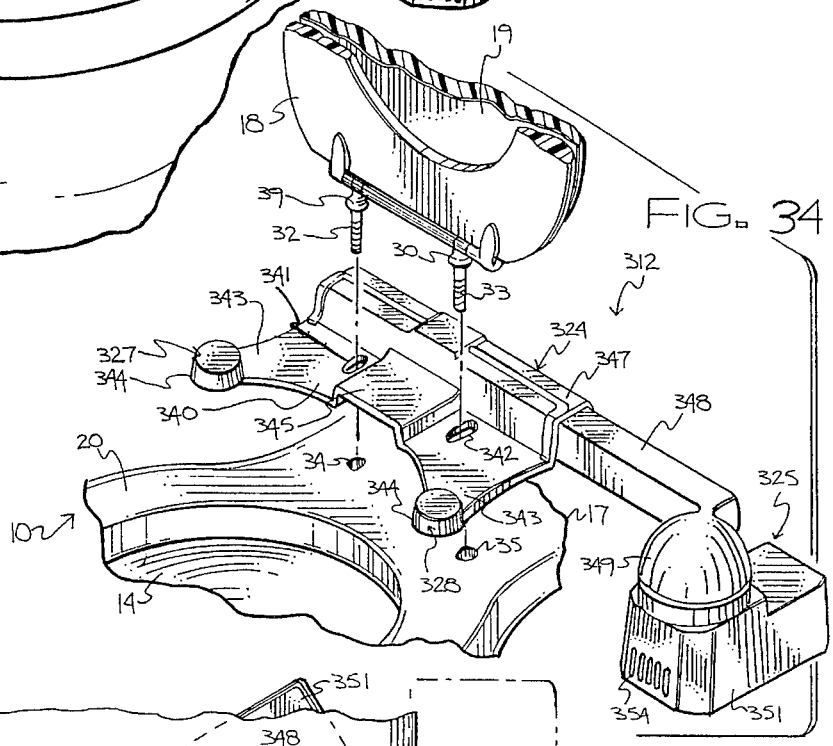
FIG. 34 is a partial exploded perspective view, illustrating how the toilet ventilating apparatus of FIG. 33 is mounted on a toilet.

As in FIG. 2, the detail of FIG. 34 illustrates the coupling of seat 18, lid 19 and odor collector 324 to toilet bowl 14. This is accomplished in the same manner as described above, with threaded ends 32 and 33 inserted through openings 34 and 35 in toilet bowl 14 and securing them with nuts (not shown). The hinge arrangement has already been described previously, and will not be described further.

Still referring to FIG. 34, odor collector 324 includes a base 340, configured to be positioned between top surface 20 of toilet bowl 14 and seat 18. A pair of slots 341 and 342, corresponding to openings 34 and 35 in toilet bowl 14, are formed through base 340 and receive threaded ends 32 and 33 of hinge posts 29 and 30. Slots 341 and 342 are employed to allow forward and rearward adjustments to be made in positioning odor collector 324. Odor collector 324 further includes a pair of opposing legs 343 extending from the front of odor collector 324 and partially along top surface 20 of toilet bowl 14, terminating in switch housings 344 containing switches 327 and 328, an air intake 345 mounted centrally between slots 341 and 342, and a sleeve 347 extending the length of base 340, rearward of and coupled to air intake 345.

Filter assembly 325 is coupled to odor collector 324 by a neck 348 configured to be slidably received by sleeve 347, and includes a generally hemispherical air duct 349 coupled to neck 348, an impeller assembly 350 and a filter 352 (not visible) carried within a filter assembly housing 351 and coupled thereby to air duct 349. Power is supplied to impeller assembly 350 by batteries contained in a battery case 353 (not visible) carried within housing 351.

Figure 35:
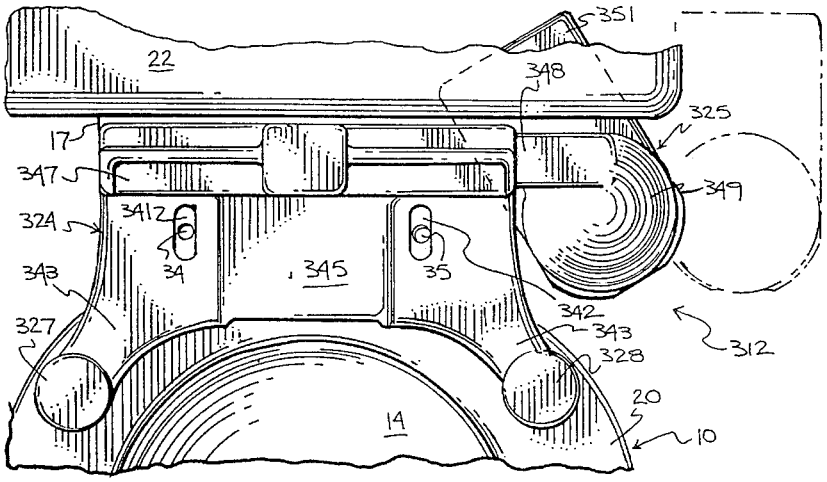
FIG. 35 is a partial top plan illustrating the adjustability of the toilet ventilating apparatus.

Toilet ventilating and deodorizing apparatus 312 is intended to be substantially unnoticeable and blend into the overall appearance of toilet 10 as is apparatus 12 and 212. To achieve this desired characteristic, filter assembly 325 is intended to be positioned adjacent back 17 of toilet bowl 14 under water tank 22 as can be seen in FIG. 35. Furthermore, the various components are adjustable since toilet ventilating and deodorizing apparatus 312 is intended to be retrofitted to substantially any toilet. Therefore, to accommodate toilets having different shapes and dimensions, neck 348 is slidably received within sleeve 347 to allow filter assembly 325 to be positioned at varying distance from odor collector 324, housing 351 is pivotally attached to air duct 349 allowing filter assembly 325 to be pivoted against the side of substantially any toilet, and slots 341 and 342 permit odor collector 324 to be properly positioned, with air intake 345 positioned to withdraw malodorous air from toilet bowl 14.

Toilet ventilating and deodorizing apparatus 312 is illustrated in FIG. 36, showing how it neatly and compactly fits against the side of toilet 10, with a large portion inconspicuously located under water tank 22. Apparatus 312 closely conforms to the lines of toilet 10 without interfering with the operation of seat 18 and lid 19.

Referring now to FIG. 37, odor collector 324 is illustrated in an inverted position. Base 340 includes a top 357 and a bottom 358 with a space 359 therebetween. A portion of bottom 358 is cut-away to show the inside of base 340. Sleeve 347 can be seen to be a substantially square tube extending the length of the rear of base 340, having an open end 360 for receiving neck 348 and a closed end 362. Air intake 345 extends from the front of base 340 to the back of base 340, having an inlet port 363, which is positioned to withdraw air from toilet bowl 14, and an outlet port 364 coupled in gaseous communication with sleeve 347. Odor collector 324 further includes a contact assembly 367 mounted within sleeve 347, fixed to a top 368 thereof, and a pair of leads 369 and 370 extending from contact assembly 367 through space 359 of base 340 to each of switch housings 344. While two pair of leads 369 and 370 are employed in this embodiment, each extending between one of switches 327 and 328 and contact assembly 367, it will be understood by one skilled in the art that only a single pair of leads 369 and 370 is required, coupled to a single switch. A redundant switch with associated pair of leads is employed to ensure that toilet ventilating and deodorizing apparatus 312 operates when a person sits on seat 18, even if that person sits off center depressing only one switch. While apparatus is shown having internal wiring for purposes of illustration, as is apparatus 312, one skilled in the art will understand that external wiring as employed in embodiment 212 may be used instead.

In order for neck 348 to slide freely within sleeve 347, each pair of leads 369 and 370 must be placed so as to avoid obstructing neck 348. As can be seen with additional reference to FIG. 38, leads 369 and 370 are recessed within a channel 372 formed in top 368. In this manner, leads 369 and 370 extend from contact assembly 367 along sleeve 347 to open end 360 and closed end 362 without interfering with neck 348. At open end 360 and closed end 362, additional channels 371 are formed coupling channel 372 to base 340.

Referring specifically to FIG. 39, contact assembly 367 consists of a contact pad 373 having a top surface 374 and bottom surface 375, constructed of a resilient insulating material such as rubber, and a pair of contacts 377 and 378 coupled to bottom surface 375. Contacts 377 and 378 each have ends angled toward top surface 374. Angled ends of contacts 377 and 378 extend from bottom surface 375 of contact pad 373, terminating adjacent top surface 374. A pair of openings 379 and 380 are formed in the front and rear of contact pad 373 underneath contacts 377 and 378. Contact pad 373 is partially recessed into a depression 382 formed in top 368, with top surface 374 of contact pad 373 fastened to top 368 of sleeve 347. Each pair of leads 369 and 370 extend from channels 372 into depression 382. Lead 369 from each pair of leads 369 and 370 is received through one of openings 379 from top surface 374 and attached to contact 377, and lead 370 from each pair of leads 369 and 370 is received through one of openings 380 from top surface 374 and attached to contact 378.

Referring now to FIG. 40, neck 348 is shown inserted within sleeve 347. Neck 348 has a generally square cross-section, with a top surface 383, a rearward side 384, and a forward side 385. A pair of contacts 388 and 389 corresponding to contacts 377 and 378 respectively, extend along top surface 383 (FIG. 42) and engage contacts 377 and 378 when neck 348 is received by sleeve 347. Contact pad 373 insures adequate engagement between contacts 377, 378 and 388, 389 by extending slightly out of depression 382. As neck 348 is inserted into sleeve 347, contacts 377 and 378 engage contacts 388 and 389 and compress contact pad 373 which, being resilient, forces contacts 377, 378 against contacts 388,389.

When neck 348 is inserted into sleeve 347, and contacts 377 and 378 firmly engage contacts 388 and 389, closing of one of switches 327 and 328 starts apparatus 312. Turning now to FIG. 41, switch 327 is illustrated. Since switch 327 and switch 328 are identical, only one is described in detail. Switch 327 is mounted on top 357 of base 340 within switch housing 344. Switch housing 344 is a substantially square chamber formed from walls 390 extending upward from top 357 of base 340, terminating in an inwardly directed rim 392 defining an opening 393. A bottom contact strip 395 is mounted on top 357 with lead 369 coupled thereto. A top contact 397 with lead 370 coupled thereto, and having a bore 398 formed therethrough, is positioned over bottom contact strip 395, separated therefrom by a resilient ring 399, preferably composed of rubber. A compression member 400 having a threaded bore 402 formed therethrough and an outwardly directed shoulder 403 formed around the periphery thereof, is carried by top contact 397 with threaded bore 402 concentric with bore 398. Inwardly directed rim 392 of housing 344 engages outwardly directed shoulder 403 of compression member 400, retaining bottom contact 395, ring 399, top contact 397, and compression member 400 within housing 344. A screw 404 extends through an element 405 of an engagement pair and continues through compression member 400, bore 398 of top contact 397 and ring 399, terminating in a spaced apart relationship with bottom contact 395. The positioning of screw 404 with respect to bottom contact 395 may be adjusted by threading screw 404 farther through or unscrewing screw 404 from threaded bore 402 of compression member 400. A cap 408 containing a complemental element 407 of the engagement pair, fits over switch housing 344 in a sliding engagement, secured to compression member 400 by the engaged element 405 and complemental element 407 of the engagement pair. Preferably the engagement pair consists of the hook and loop elements of Velcro®.

Switch 327 is closed by seat 18 pressing against cap 408 with sufficient force, such as when a person is seated thereon, to depress compression member 400. It will be seen that if sufficient force is applied to cap 408, compression member 400 is forced downward, compressing resilient ring 399 and bringing screw 404 into contact with bottom contact 395. When this occurs, the gap between bottom contact 395 and top contact 397 is bridged, closing the switch, and coupling lead 369 to 370, which extend back through space 359 of base 340 to contact assembly 367.

Referring now to FIG. 42, neck 348, as discussed previously in connection with FIG. 40, includes top surface 383 carrying contacts 388 and 389, rearward side 384 and forward side 385. Neck 348 further includes an insert end 410 receivable within sleeve 347 as described previously, and an opposing end 412 coupled to air duct 349. An opening 413 is formed in forward side 385 proximate insert end 410, allowing admittance of malodorous air from air intake 345. Opening 413 is somewhat elongate to allow adjustment of neck 348 while maintaining communication between opening 413 and outlet port 364. An opening 414 is formed in opposing end 412, through which malodorous air leaves neck 348 to enter filter assembly 325. A pair of leads 417 and 418 extend through opening 414 into neck 348 and are coupled to an end of contacts 388 and 389 respectively. An opposing end of contacts 388 and 389, positioned proximate insert end 410, is rounded so that contacts 388 and 389 will easily slide onto contact assembly 367 without catching an edge and causing damage.

Figure 43:
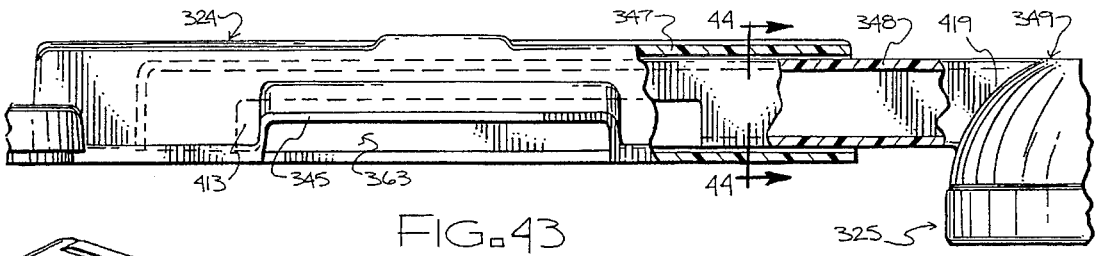
FIG. 43 is a partial sectional view of the sliding engagement between the neck and the sleeve.

Odor collector 324 is coupled in gaseous communication with filter assembly 325 by neck 348 extending between sleeve 347 and an inlet 419 of air duct 349, as can be seen with reference to FIG. 43. With additional reference to FIG. 44, neck 348 is shown received within sleeve 347, with leads 417 and 418 passing inside neck 348 to continue on to air duct 349, and leads 369 and 370 depressed within channel 372 avoiding interference with neck 348.

Figure 45:
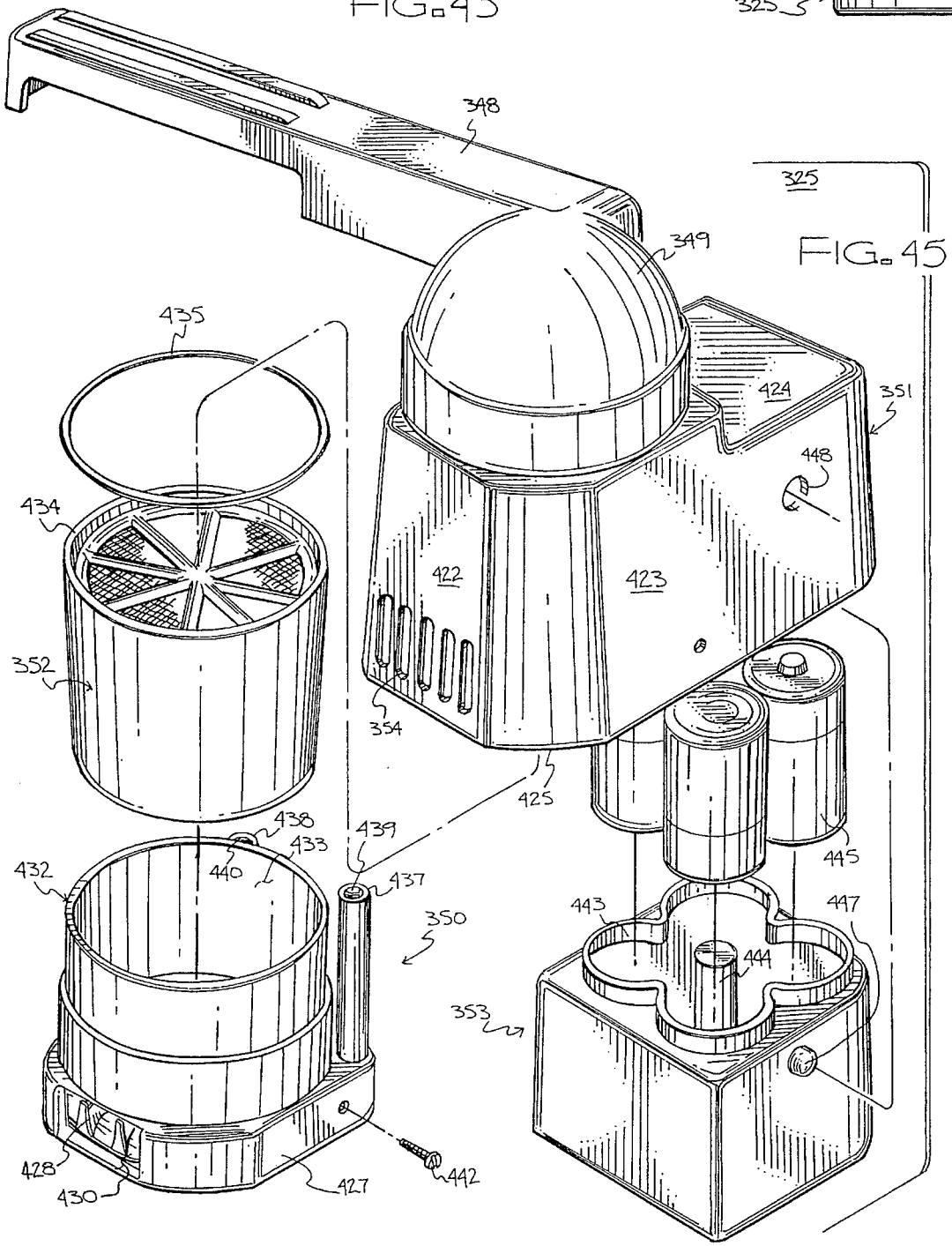
FIG. 45 is an exploded perspective view of the filter assembly.

Turning now to FIG. 45, housing 351 of filter assembly 325 includes endwalls 422, sidewalls 423, a top 424, and an open bottom 425, configured to receive impeller assembly 350 and battery case 353. Air duct 349 is rotatably coupled to top 424 of housing 351 the details of which will be described below. Impeller assembly 350 includes a housing 427 containing a fan 428, and has an inlet 429 (not visible) and an outlet 430. A socket 432 extends from housing 427 and defines a receptacle 433 over inlet 429. Filter 352 is received within receptacle 433 of socket 432, covering inlet 429. The walls of socket 432 slope radially outward to provides a tight fit around the periphery of filter 352, preventing air flow around same. A ridge 434 extends from and encircles the top end of filter 352, configured to be received by housing 427, with an o-ring 435 sealing the engagement. A pair of contact posts 437 and 438 extend upward from housing 427, terminating in contacts 439 and 440 respectively. The purpose of posts 437 and 438 will be discussed in greater detail presently. Impeller assembly 350 is held securely in place by screws 442 inserted through housing 351 into housing 427.

Battery case 353 is a box having braces 443 and a center post 444 securely retaining batteries. Battery case 353 preferably holds four D cell batteries 445. Battery case 353 is received within housing 351 adjacent impeller assembly 350 and secured by securing means preferably consisting of an easily engageable and disengageable detent 447 received by a corresponding opening 448 formed in sidewall 423 of housing 351. With additional reference to FIG. 46, means for securing battery case 353 within housing 351 is illustrated. While those skilled in the art will understand that various known securing apparatus may be used, preferably, a biasing member 449 from which detent 447 extends, is attached to the inner surface of battery case 353 with detent 447 extending out through an opening 450. To insert battery case 353 into housing 351, detent 447 is forced inward, back into battery case 353 through opening 450 against the bias of bias member 449 as indicated by broken lines. Battery case 353 will then freely enter housing 351 from open bottom 425. Once properly positioned, opening 450 will align with opening 448 in housing 351 and detent 447 will be forced concurrently through openings 450 and 448 securing battery case 353 in place.

A detailed view of the inner workings of filter assembly 325 is illustrated in FIG. 47. Malodorous air enters filter assembly 325 through neck 348 into air duct 349. Housing 351 further includes an opening 452 defined by in turned lips 453 formed in top 424 which receives o-ring 435 and the upper edge of socket 432 thereagainst. Air duct 349 is constructed of an inner member 454 and an outer member 455 rotatably coupled thereto. Inner member 454 has an outwardly flared lower edge 457 which is inserted through opening 452 and engage inwardly directed lip 453. Outer member 455, from which neck 348 extends, has a lower edge 458 extending outside of housing 351. The malodorous air passes through air duct 349 into filter 352, being drawn by rotation of fan 428. Fan 428 is driven by a motor 459 positioned within a hub 460 thereof, powered by batteries 445 within case 353.

Figure 49:
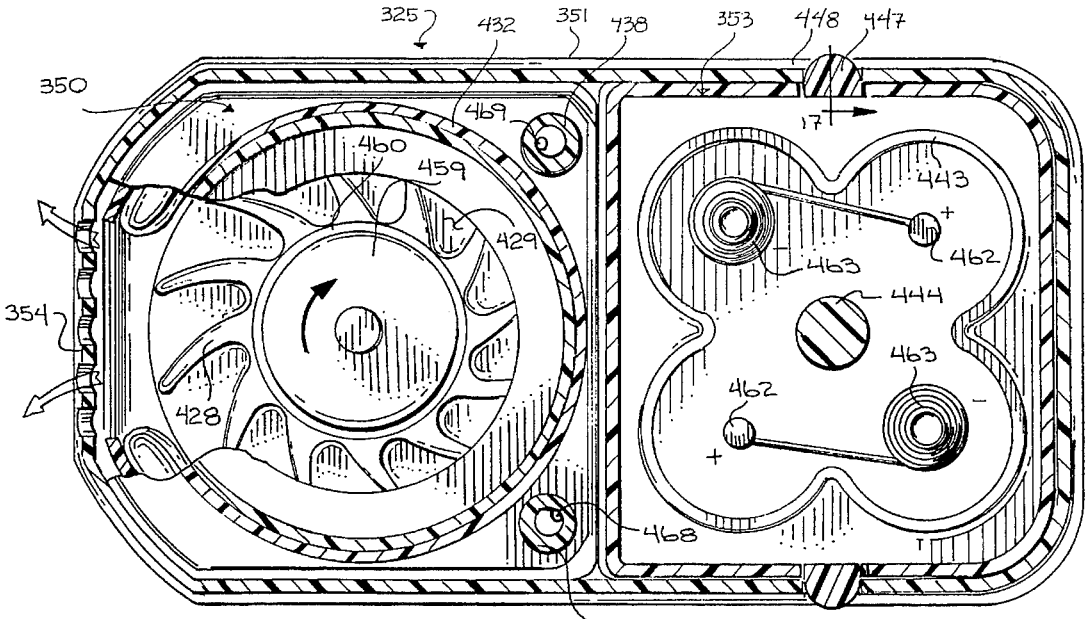
FIG. 49 is a sectional view taken along line 49—49 of FIG. 47.
Figure 50:
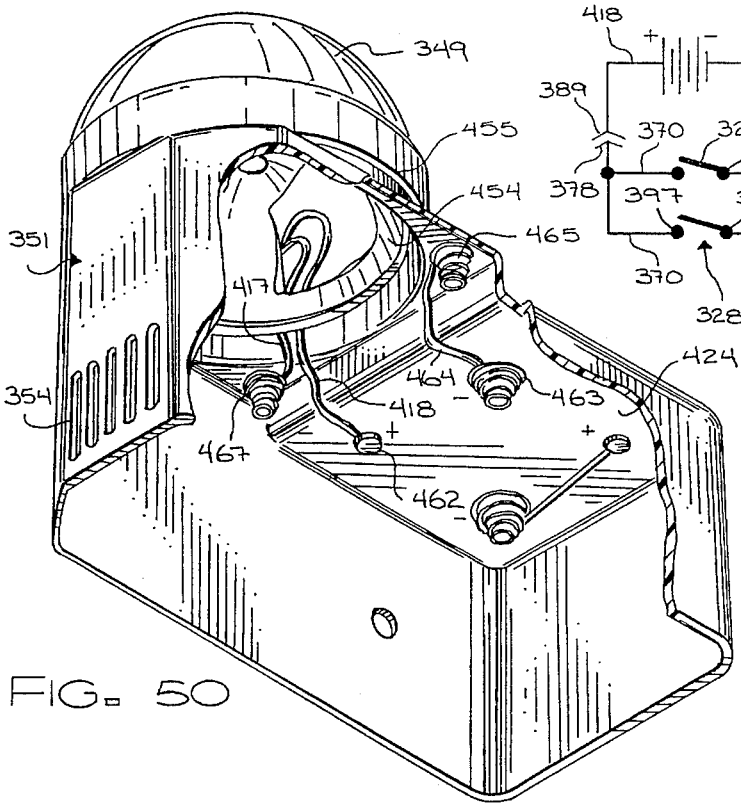
FIG. 50 is a perspective view illustrating the housing of the filter assembly.

Still referring to FIG. 47, with additional reference to FIGS. 49 and 50, alternating pairs of cross-connected terminal contacts are mounted within battery case 353 and housing 351. Positive terminal contacts 462 alternately mounted within battery case 353 and housing 351 oppose negative terminal contacts 463. Negative and positive terminal contacts 463 and 462 respectively, are conventional terminal contacts for receiving batteries 445, with the negative terminal contacts 463 being compression coils to insure a secure fit and connection. Negative and positive terminal contact 463 and 462 are coupled in a conventional manner, with negative terminals 463 coupled by a lead 464 to a contact 465 mounted inside housing 351 on top 424, and positive terminals 462 coupled to lead 418 extending from contact 389 in neck 348, through air duct 349, between inner and outer members 454 and 455. Lead 417 from neck 348 parallels lead 418 and terminates in a contact 467 mounted inside housing 351 on top 424 spaced apart from contact 465.

FIG. 48 illustrates a lead 468 coupled to motor 459 extending up post 437 and terminating in contact 439. It will be understood that another lead 469 extends from motor 459 up post 438, to terminate in contact 440. Posts 437 and 438 with corresponding leads 468 and 469 respectively, can be seen with additional reference to FIG. 49. When impeller assembly 350 is secured within housing 351, contacts 439 and 440 on posts 437 and 438 engage contacts 465 and 467 respectively. At this point, closing of one of switches 327 and 328 completes the circuit, and starts operation of toilet ventilating and deodorizing apparatus 312.

Figure 51:
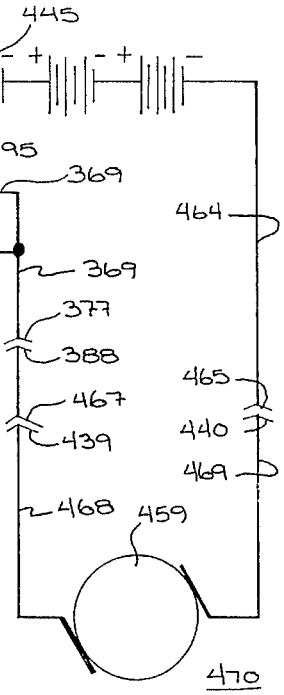
FIG. 51 is a circuit diagram of the alternate embodiment of the toilet ventilating apparatus.

A diagrammatic representation of an operating circuit 470 of toilet ventilating and deodorizing apparatus 312 is illustrated in FIG. 51. Switches 327 and 328 having contacts 395 and 397 are coupled in parallel, each having leads 370 extending from contacts 397 which terminate at contact 378, and leads 369 extending from contacts 395 which terminate at contact 377. Progressing from switches 327 and 328 in a clock wise direction, contact 378, found in sleeve 347, is coupled to contact 389 of neck 348 when neck 348 is inserted into sleeve 347. Lead 418 extends from contact 389 and is coupled to the positive terminal of batteries 445 by mounting battery case 353 onto impeller assembly 350. The negative terminal of batteries 445 are coupled to motor 459 through leads 464 and 469 when impeller assembly 350 is mounted coupling contacts 465 and 440. Lead 468 then couples motor 459 to switches 327 and 328 by two couplings. Lead 468 terminates in contact 439 on post 437 which, when impeller assembly 350 is fitted to housing 351 engages contact 467. Lead 417, extending from contact 467 terminates in contact 388 of neck 348. Contact 388 engages contact 377 of sleeve 347, coupling lead 417 to leads 369. Upon closing of either or both switches 327 and 328, circuit 470 is completed and motor 459 is powered.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. A toilet ventilating and deodorizing apparatus for extracting and filtering air from a toilet bowl, said apparatus comprising:

an odor collector for extracting air from said toilet bowl, said odor collector including:

a base having attachment means for attaching said base to said toilet bowl;

an air intake carried by said base and positionable adjacent an interior of said toilet bowl; and a sleeve having an open end for slidably receiving a neck, carried by said base in gaseous communication with said air intake;

a filter assembly for deodorizing the air extracted from said toilet bowl, said filter assembly having:

an air duct having an inlet and an outlet, said inlet coupled to said neck;

an impeller assembly for providing air flow through said apparatus, coupled to said outlet of said air duct; and a filter carried between said impeller assembly and said air duct;

said neck adjustably coupling said filter assembly to said odor collector, said neck supporting said filter assembly adjacent said toilet bowl and providing gaseous communication between said filter assembly and said odor collector;

switch means carried by said odor collector for activating said filter assembly;

a power source for supplying power to said assembly; and a power circuit coupling said power source to said filter assembly and said switch means, said power circuit having internal leads, extending from said impeller assembly, said power source and internally through said air duct, said neck and said odor collector, to said switch means;

a contact assembly mounted within said sleeve electrically coupled to said switch means; and corresponding contacts mounted on said neck, engagable and disengagable with said contact assembly, said corresponding contacts engagable with said contact assembly over an extended range, permitting inward and outward adjustments of said neck within said sleeve while maintaining electrical contact.

2. An apparatus as claimed in claim 1 wherein said contact assembly includes a resilient member mounted within said sleeve, and carrying a pair of contacts corresponding to said contacts of said neck.

3. An apparatus as claimed in claim 1 further including:

a contact carried by said air duct; and a corresponding contact carried by said impeller assembly engagable and disengagable with said contact carried by said air duct.

4. A toilet ventilating and deodorizing apparatus for extracting and filtering air from a toilet bowl, said apparatus comprising:

an odor collector for extracting air from said toilet bowl;

a filter assembly for deodorizing the air extracted from said toilet bowl, said filter assembly including:

an air duct having an inlet and an outlet, said inlet coupled to a neck;

an impeller assembly for providing air flow through said apparatus, coupled to said outlet of said air duct, wherein said impeller assembly includes:

a housing having an inlet and an outlet, coupled to said air duct with said inlet in gaseous communication with said outlet of said air duct;

a fan carried within said housing for producing the air flow;

actuator means for rotating said fan, carried within said housing; and a socket extending from said housing about said inlet, for receiving said filter and for coupling said housing to said air duct;

said neck adjustably coupling the inlet of said filter assembly to said odor collector, said neck supporting said filter assembly adjacent said toilet bowl and providing gaseous communication between said filter assembly and said odor collector;

switch means carried by said odor collector for activating said filter assembly;

a power source for supplying power to said assembly;

a power circuit coupling said power source to said filter assembly and said switch means;

a filter assembly housing having an inlet, an outlet, and an access port;

said outlet of said air duct coupled to said inlet of said filter assembly housing; and said filter assembly housing carrying said impeller assembly with said socket engaging said outlet of said air duct, and said filter assembly housing carrying said power source.

5. An apparatus as claimed in claim 4, wherein said power source is a battery case containing a battery, disengageably coupled to a pair of contacts mounted within said filter assembly housing, and wherein said housing of said impeller assembly carries a pair of contacts removably engagable with said contact mounted within said filter assembly housing.

6. An apparatus as claimed in claim 4, wherein said air duct includes an inner portion coupled to said filter assembly housing, and an outer portion rotatably coupled to said inner portion.

7. A toilet ventilating and deodorizing apparatus for extracting and filtering air from a toilet bowl, said apparatus comprising:

an odor collector for extracting air from said toilet bowl, said odor collector including:

a base having attachment means for attaching said base to said toilet bowl;

an air intake carried by said base and positionable adjacent an interior of said toilet bowl; and a sleeve having an open end, carried by said base in gaseous communication with said air intake;

a filter assembly for deodorizing the air extracted from said toilet bowl, said filter assembly including:

an air duct having an inlet and an outlet;

an impeller assembly for providing air flow through said apparatus, coupled to said outlet of said air duct; and a filter carried between said impeller assembly and said air duct;

a neck having a first end removably and slidably received through said open end of said sleeve, and a second end coupled to said inlet of said air duct, said odor collector and said neck supporting said filter assembly adjacent said toilet bowl;

switch means carried by said odor collector for activating said filter assembly, said switch means including:

a switch housing formed in said base;

a pressure switch carried by said base within said switch housing; and a cap covering said switch housing and engaging said switch;

a power source for supplying power to said impeller assembly; and a power circuit coupling said power source to said impeller assembly and said switch means.

8. An apparatus as claimed in claim 7 wherein said pressure switch includes:

a first contact member;

a second contact member;

a resilient member separating said first contact member from said second contact member; and a bridging member which couples said first contact member to said second contact member upon compression of said resilient member.

9. An apparatus as claimed in claim 8 wherein said bridging member includes a screw extending from said first contact member through said resilient member, terminating in a spaced apart relationship with said second contact member, moving from said spaced apart position and into contact with said second resilient member upon sufficient compression of said compression member.

10. A toilet ventilating and deodorizing apparatus for extracting and filtering air from a toilet bowl, said apparatus comprising:

an odor collector for extracting air from said toilet bowl, said odor collector including:

a base having attachment means for attaching said base to said toilet bowl;

an air intake carried by said base and positionable adjacent an interior of said toilet bowl; and a sleeve having an open end, carried by said base in gaseous communication with said air intake;

a filter assembly for deodorizing the air extracted from said toilet bowl, said filter assembly including:

an air duct having an inlet and an outlet;

an impeller assembly for providing air flow through said apparatus, coupled to said outlet of said air duct, wherein said impeller assembly includes:

a housing having an inlet and an outlet, coupled to said air duct with said inlet in gaseous communication with said outlet of said air duct;

a fan carried within said housing for producing the air flow;

actuator means for rotating said fan, carried within said housing; and a socket extending from said housing about said inlet, for receiving said filter and for coupling said housing to said air duct;

a filter carried between said impeller assembly and said air duct;

a neck having a first end removably and slidably received through said open end of said sleeve, and a second end coupled to said inlet of said air duct, said odor collector and said neck supporting said filter assembly adjacent said toilet bowl;

switch means carried by said odor collector for activating said filter assembly;

a power source for supplying power to said impeller assembly, wherein said power source is a battery contained within a battery case; and a power circuit coupling said power source to said impeller assembly and said switch means, wherein said power circuit includes internal leads, extending from said actuator means, internally to said battery case, and through said air duct, said neck and said odor collector, to said switch means.

11. An apparatus as claimed in claim 10 further including:

a contact assembly mounted within said sleeve electrically coupled to said switch means; and corresponding contacts mounted on said neck, engagable and disengagable with said contact assembly, said corresponding contacts engagable with said contact assembly over an extended range, permitting inward and outward adjustments of said neck within said sleeve while maintaining electrical contact.

12. An apparatus as claimed in claim 11 wherein said contact assembly includes a resilient member mounted within said sleeve, and carrying a pair of contacts corresponding to said contacts of said neck.

13. An apparatus as claimed in claim 11 further including:

a contact carried by said air duct; and a corresponding contact carried by said housing of said impeller assembly, engagable and disengagable with said contact carried by said air duct.

14. A toilet ventilating and deodorizing apparatus for extracting and filtering air from a toilet bowl, said apparatus comprising:

an odor collector for extracting air from said toilet bowl, said odor collector including:

a base having attachment means for attaching said base to said toilet bowl;

an air intake carried by said base and positionable adjacent an interior of said toilet bowl; and a sleeve having an open end, carried by said base in gaseous communication with said air intake;

a filter assembly for deodorizing the air extracted from said toilet bowl, said filter assembly including:

an air duct having an inlet and an outlet;

an impeller assembly for providing air flow through said apparatus, coupled to said outlet of said air duct, wherein said impeller assembly includes:

a housing having an inlet and an outlet, coupled to said air duct with said inlet in gaseous communication with said outlet of said air duct;

a fan carried within said housing for producing the air flow;

actuator means for rotating said fan, carried within said housing; and a socket extending from said housing about said inlet, for receiving said filter and for coupling said housing to said air duct;

a filter carried between said impeller assembly and said air duct;

a neck having a first end removably and slidably received through said open end of said sleeve, and a second end coupled to said inlet of said air duct, said odor collector and said neck supporting said filter assembly adjacent said toilet bowl;

switch means carried by said odor collector for activating said filter assembly;

a power source for supplying power to said impeller assembly; and a power circuit coupling said power source to said impeller assembly and said switch means;

a filter assembly housing having an inlet, an outlet, and an access port;

said outlet of said air duct coupled to said inlet of said filter assembly housing; and said filter assembly housing carrying said impeller assembly with said socket engaging said outlet of said air duct, and filter assembly housing carrying said power source.

15. An apparatus as claimed in claim 14, wherein said power source is a battery case containing a battery, disengageably coupled to a pair of contacts mounted within said filter assembly housing, and wherein said housing of said impeller assembly carries a pair of contacts removably engagable with said contact mounted within said filter assembly housing.

16. An apparatus as claimed in claim 14, wherein said air duct includes an inner portion coupled to said filter assembly housing, and an outer portion rotatably coupled to said inner portion.

* * * * *